US009927079B2

(12) United States Patent
Gould et al.

(10) Patent No.: US 9,927,079 B2
(45) Date of Patent: Mar. 27, 2018

(54) RECESSED LUMINAIRE

(71) Applicant: ABL IP Holding LLC, Atlanta, GA (US)

(72) Inventors: Carl Gould, Golden, CO (US); Peter K. Nelson, Denver, CO (US); Chris Sorensen, Denver, CO (US); Chris Slaughter, Denver, CO (US); Kevin F. Leadford, Evergreen, CO (US)

(73) Assignee: ABL IP Holding LLC, Atlanta, GA (US)

( * ) Notice: Subject to any disclaimer, the term of this patent is extended or adjusted under 35 U.S.C. 154(b) by 579 days.

(21) Appl. No.: 13/866,971

(22) Filed: Apr. 19, 2013

(65) Prior Publication Data

US 2014/0070724 A1 Mar. 13, 2014

Related U.S. Application Data

(60) Provisional application No. 61/699,459, filed on Sep. 11, 2012, provisional application No. 61/784,748, filed on Mar. 14, 2013.

(51) Int. Cl.
*F21V 1/00* (2006.01)
*F21S 8/02* (2006.01)
(Continued)

(52) U.S. Cl.
CPC ..... *F21S 8/024* (2013.01); *F21V 5/00* (2013.01); *F21V 7/0016* (2013.01); *F21V 13/02* (2013.01);
(Continued)

(58) Field of Classification Search
CPC .... F21S 8/02; F21S 8/024; F21S 8/026; F21S 8/033; F21S 8/036; F21S 8/043;
(Continued)

(56) References Cited

U.S. PATENT DOCUMENTS 1,348,957 A 8/1920 Pope
1,480,375 A 1/1924 Cristadoro
(Continued)

FOREIGN PATENT DOCUMENTS

WO 2014043268 3/2014

OTHER PUBLICATIONS

Non-Final Office Action for U.S. Appl. No. 13/866,939, dated Jul. 9, 2014, 24 pages.
(Continued)

*Primary Examiner* — Bryon T Gyllstrom
*Assistant Examiner* — James Endo
(74) *Attorney, Agent, or Firm* — Kilpatrick Townsend & Stockton LLP

(57) ABSTRACT

Embodiments of the invention are directed to wall recessed two-component luminaires. The two components can include a primary optical subsystem and a secondary optical subsystem. The primary optical subsystem can provide indirect lighting, illuminate an architectural space upward toward a ceiling, and/or have greater luminous flux than the secondary optical subsystem. The secondary optical subsystem can provide direct lighting, illuminate an architectural space horizontally and/or downward, provide lit appearance, provide direct view color and/or color gradients, provide direct view luminance and/or luminous gradients, and/or provide lighting for ambience.

42 Claims, 19 Drawing Sheets

(51) Int. Cl.

| | |
|---|---|
| ***F21V 13/02*** | (2006.01) |
| ***H05B 37/02*** | (2006.01) |
| ***F21V 5/00*** | (2018.01) |
| ***F21V 7/00*** | (2006.01) |
| ***F21V 23/00*** | (2015.01) |
| *F21S 6/00* | (2006.01) |
| *F21V 21/02* | (2006.01) |
| *F21V 5/08* | (2006.01) |
| *F21V 21/04* | (2006.01) |
| *F21S 8/00* | (2006.01) |
| *F21K 9/62* | (2016.01) |
| *F21Y 105/00* | (2016.01) |
| *F21Y 115/10* | (2016.01) |
| *F21Y 115/15* | (2016.01) |
| *F21Y 113/13* | (2016.01) |

(52) U.S. Cl.

CPC ..... *F21V 23/009* (2013.01); *H05B 37/02* (2013.01); *F21K 9/62* (2016.08); *F21S 6/008* (2013.01); *F21S 8/033* (2013.01); *F21V 5/08* (2013.01); *F21V 21/025* (2013.01); *F21V 21/04* (2013.01); *F21Y 2105/00* (2013.01); *F21Y 2113/13* (2016.08); *F21Y 2115/10* (2016.08); *F21Y 2115/15* (2016.08); *H05B 37/0209* (2013.01)

(58) Field of Classification Search

CPC .... F21S 8/008; F21S 8/031; F21S 8/00; F21S 10/023; F21S 6/008; F21V 7/0016; F21V 21/025; F21V 21/04; F21V 7/0008; F21V 7/0041; F21V 23/009; F21V 29/507; F21V 13/02; F21V 21/02; F21V 21/047; F21V 21/044; F21V 21/042; F21V 21/045; F21V 21/046; F21V 21/048; F21V 5/08; F21Y 2113/02; F21K 9/62

USPC ..... 362/235, 240, 246, 243, 245, 249.01, 362/236, 242, 311.02, 247, 806, 145, 147, 362/223, 217.04, 249.02, 249.16, 355; 315/291, 245

See application file for complete search history.

(56) References Cited

U.S. PATENT DOCUMENTS 1,937,139 A * 11/1933 Barclay ..... G09F 13/0409 359/619
3,700,880 A 10/1972 Smith
4,490,776 A 12/1984 Kluch
5,285,356 A * 2/1994 Skene ..... F21S 2/00 362/1
5,662,403 A * 9/1997 Akashi ..... F21S 8/02 362/292
5,977,694 A 11/1999 McGuire
6,363,636 B1 * 4/2002 Hess ..... F21S 10/04 40/428
6,393,207 B1 * 5/2002 Martin ..... F24C 7/004 362/806
6,461,032 B2 10/2002 McKinley
6,606,453 B2 8/2003 Morgan et al.
6,690,120 B2 2/2004 Oskorep et al.
6,789,914 B1 * 9/2004 Brown ..... F21S 8/02 362/147
6,798,154 B1 9/2004 Sullivan et al.
6,932,487 B2 8/2005 Aknine
6,944,982 B2 * 9/2005 Schroeter ..... F24C 7/004 392/348
7,090,375 B2 * 8/2006 Kuisma ..... B60Q 3/004 362/219
7,246,919 B2 7/2007 Porchia et al.
7,322,136 B2 * 1/2008 Chen ..... F24C 7/004 362/217.05
7,348,736 B2 3/2008 Piepgras et al.
7,502,170 B2 * 3/2009 Nakano ..... G01N 21/8806 359/290
7,604,378 B2 10/2009 Wolf et al.
7,614,767 B2 11/2009 Zulim et al.
7,658,506 B2 2/2010 Dowling
7,845,823 B2 12/2010 Mueller et al.
8,100,552 B2 1/2012 Spero
8,425,101 B2 4/2013 Boonekamp
2003/0034985 A1 * 2/2003 Needham Riddle ..... G01J 1/08 345/589
2003/0179574 A1 * 9/2003 Kuisma ..... B60Q 3/004 362/217.09
2004/0052076 A1 3/2004 Mueller et al.
2004/0120160 A1 * 6/2004 Natsume ..... B60Q 1/0058 362/544
2004/0125610 A1 7/2004 Lekson et al.
2005/0265023 A1 12/2005 Scholl
2006/0072317 A1 4/2006 Noordhoek
2006/0238136 A1 10/2006 Johnson et al.
2006/0277857 A1 * 12/2006 Bonshor ..... E06B 1/62 52/518
2007/0081362 A1 4/2007 Lin
2007/0147036 A1 * 6/2007 Sakai ..... G02B 6/0096 362/240
2007/0171676 A1 * 7/2007 Chang ..... G02B 6/0046 362/613
2007/0206375 A1 * 9/2007 Piepgras ..... A43B 1/0027 362/147
2007/0217193 A1 * 9/2007 Lin ..... F21V 7/0008 362/245
2007/0263379 A1 * 11/2007 Dowling ..... F21S 8/024 362/151
2007/0263393 A1 * 11/2007 Van De Ven ..... F21V 29/2212 362/362
2008/0130282 A1 6/2008 Negley
2008/0170380 A1 * 7/2008 Pastore ..... G01N 21/8806 362/16
2008/0204888 A1 8/2008 Kan et al.
2008/0259596 A1 * 10/2008 Biebl ..... F21V 29/004 362/228
2008/0273323 A1 * 11/2008 Ladstaetter ..... F21S 8/04 362/231
2009/0002986 A1 * 1/2009 Medendorp, Jr. ..... F21S 8/06 362/247
2009/0243455 A1 10/2009 Biebel et al.
2009/0244893 A1 10/2009 Villard
2009/0290348 A1 11/2009 Van Laanen et al.
2010/0079087 A1 * 4/2010 Watanabe ..... F21S 8/04 315/294
2010/0225639 A1 9/2010 Kubis et al.
2010/0237803 A1 9/2010 Wolf et al.
2010/0246174 A1 * 9/2010 Ido ..... G01N 21/8806 362/235
2010/0290208 A1 * 11/2010 Pickard ..... B60Q 1/0052 362/84
2010/0309647 A1 12/2010 Winkler et al.
2010/0321919 A1 * 12/2010 Yang ..... F21K 9/00 362/84
2011/0002114 A1 * 1/2011 Koerner ..... A47F 3/001 362/126
2011/0002682 A1 * 1/2011 Messina ..... F21V 7/0008 396/200
2011/0008035 A1 * 1/2011 Messina ..... G02B 19/0023 396/200
2011/0019408 A1 * 1/2011 Jang ..... F21V 7/0008 362/235
2011/0058358 A1 3/2011 Soo et al.
2011/0187273 A1 8/2011 Summerford et al.
2011/0199765 A1 * 8/2011 Simons ..... F21V 7/0008 362/235
2011/0267839 A1 11/2011 Kang et al.
2012/0002406 A1 1/2012 Leadford et al.
2012/0002408 A1 1/2012 Lichten et al.
2012/0044675 A1 2/2012 Buelow et al.

(56) References Cited

U.S. PATENT DOCUMENTS

| | | | | |
|---|---|---|---|---|
| 2012/0091917 | A1 | 4/2012 | Vinther et al. | |
| 2012/0112661 | A1* | 5/2012 | van de Ven ..... | H05B 33/0803 315/294 |
| 2013/0020956 | A1 | 1/2013 | Zhang et al. | |
| 2013/0033865 | A1 | 2/2013 | Vinther et al. | |
| 2013/0258688 | A1 | 10/2013 | Kalapodas | |
| 2014/0071673 | A1 | 3/2014 | Gould et al. | |

OTHER PUBLICATIONS

Office Action for Canadian Application No. CA 2,883,639, dated Mar. 16, 2016, 4 pages.
Restriction Requirement for U.S. Appl. No. 14/427,588, dated Apr. 26, 2017, 9 pages.
Office Action for Canadian Application No. CA 2,883,639, dated Mar. 3, 2017, 3 pages.
Notice of Allowance for Canadian Application No. CA 2,883,639, dated Jul. 31, 2017, 1 page.
Non-Final Office Action for U.S. Appl. No. 14/427,588, dated Jul. 27, 2017, 26 pages.
Final Office Action for U.S. Appl. No. 14/427,588, dated Jan. 12, 2018, 28 pages.

* cited by examiner

RECESSED LUMINAIRE

CROSS REFERENCE TO RELATED APPLICATIONS

This application claims priority to U.S. Provisional Patent Application No. 61/699,459, filed Sep. 11, 2012, entitled "Wall-Recessed Two Component Luminaire," and to U.S. Provisional Patent Application No. 61/784,748, filed Mar. 14, 2013, entitled "Wall-Recessed Two Component Luminaire." Each of these references is hereby incorporated by reference in its entirety for all purposes.

BACKGROUND

Rooms are often illuminated by either natural light or by artificial light. Natural light has many benefits over artificial light, but may not be available or be practical. An advantageous arrangement for some spaces may be a combination of artificial and natural light. Imitation windows exist, but they are typically mounted on the wall and only emit a single type of light. This tends to give the appearance of a television screen or backlit sign/poster on the wall and fails to provide either the type or amount of light necessary to light the room.

BRIEF SUMMARY

The terms "invention," "the invention," "this invention," and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention are directed to wall recessed two-component luminaires. The two components can include a primary optical subsystem and a secondary optical subsystem. In some embodiments, the primary optical subsystem can provide indirect lighting, illuminate an architectural space indirectly by projecting light upward toward a ceiling, and/or provide light with more lumens than the secondary optical subsystem. In some embodiments, the secondary optical subsystem can provide direct lighting, illuminate an architectural space horizontally and/or downward, provide lit appearance, direct view color, direct view luminance, and/or lighting for ambience.

BRIEF DESCRIPTION OF THE DRAWINGS

Illustrative embodiments of the present invention are described in detail below with reference to the following figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention are directed toward a two component, wall recessed (or surface mounted) luminaire that includes a primary optical subsystem and a secondary optical subsystem. In some embodiments, the primary optical subsystem can be configured to illuminate while the secondary optical subsystem can be configured to provide aesthetic lighting. Various different examples, embodiments and configurations of this general concept are described below.

In some embodiments, each subsystem may include one or more light sources, lenses, reflectors, collimators, diffusing optical elements, controllers, hardware, etc. Generally speaking, the primary optical subsystem can direct light upward relative to the luminaire to provide indirect lighting within an architectural space. The secondary optical subsystem can direct light horizontally and/or downwardly to directly illuminate the architectural space, provide lit appearance, provide direct view color, and/or provide direct view luminance. In some embodiments, both the primary optical subsystem and the secondary optical subsystem illuminate the architectural space from the same wall cavity or a cavity designed to be inserted into a wall. In some embodiments, this combination of primary and secondary optical subsystems can provide an illumination within the architectural space that shares qualities of or is suggestive of natural light from a window, portal, or translucent architectural element (e.g. glass block).

Figure 1:
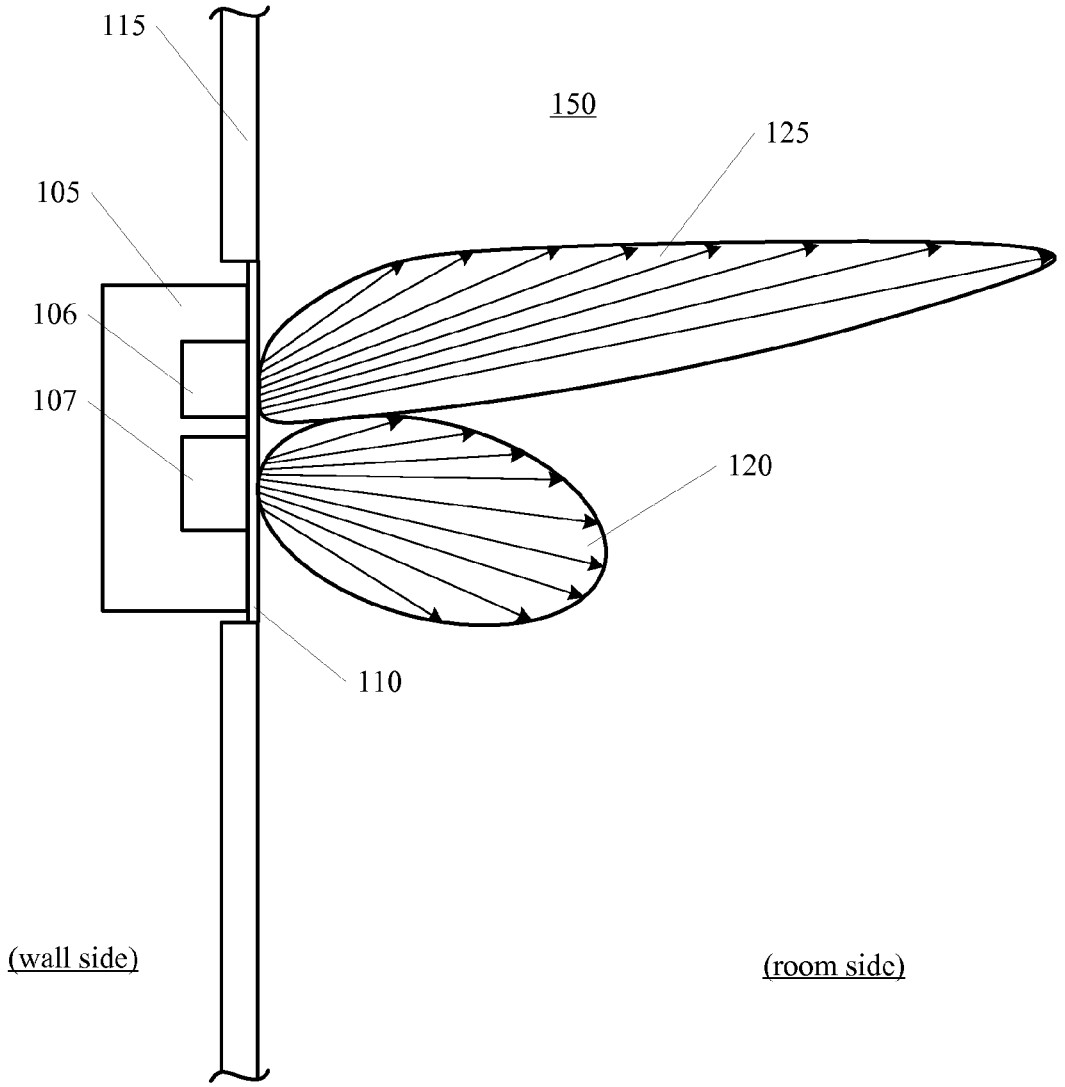
FIG. 1 shows the photometric distribution from a primary optical subsystem and a secondary optical subsystem of a wall recessed two-component luminaire according to some embodiments of the invention.

FIG. 1 shows a block diagram example of a photometric distribution from primary optical subsystem 106 and secondary optical subsystem 107 according to some embodiments of the invention. The blocks showing primary optical subsystem 106 and secondary optical subsystem 107 are functional block diagrams only. Luminaire 105 is shown recessed within wall 115 behind front optical element 110 fitting within an aperture. Luminaire 105 can include primary optical subsystem 106 and secondary optical subsystem 107. Each optical subsystem can include one or more discrete light sources such as light emitting diodes (LEDs), optical elements (e.g., lenses, diffusers, reflectors, etc.), control circuitry, power, etc. In some embodiments, light from both primary optical subsystem 106 and secondary optical subsystem 107 can be distributed into architectural space 150 from the same cavity within wall 115. Moreover, some overlap between the photometric distribution from primary optical subsystem 106 and secondary optical subsystem 107 can, but does not have to, occur.

Primary photometric distribution 125 is an example of the photometric distribution of light from primary optical subsystem 106 within luminaire 105. Primary photometric distribution 125 directs light substantially upwards relative to luminaire 105 in such a way that the light can be directed along a ceiling to indirectly illuminate the architectural space. For example, primary optical subsystem 106 can cast some of the light across the ceiling. As another example, the majority of the light can be directed above horizontal (e.g., above the luminaire when disposed within a wall); for example, more than 70%, 75%, 80%, 85%, 90%, 95%, or 100% of the light from primary optical subsystem 106 can be directed above horizontal. In some embodiments, the components that make up primary optical subsystem (e.g., LEDs, lenses, heat sinks, etc.) are generally not viewable by an occupant of the architectural space. In some configurations, the upward projection of the primary optical subsystem 106 can ensure that this is so, and in other configurations, the primary optical subsystem can be positioned within the luminaire body beneath the aperture to ensure that it is not seen by an occupant.

Secondary photometric distribution 120 is an example of the photometric distribution of light from secondary optical subsystem 107 within luminaire 105. Secondary photometric distribution 120 distributes light directly into the architectural space. In some embodiments, light from the secondary optical subsystem 107 can uniformly fill the architectural space.

In some embodiments, most of the light provided by the secondary optical subsystem is directed horizontally and/or downwardly. For example, in some embodiments, more than 50%, 55%, 60%, 65%, 70%, 75%, 80%, 85%, 90%, 95%, or 100% of the light can be directed at or below horizontal. In other embodiments, the secondary optical subsystem can direct light with a largely uniform distribution.

In some embodiments, some crossover between the two photometric distributions 125, 120 may occur. For example, in some embodiments, secondary optical subsystem 107 can emit a significant percentage of its light in an upward direction. In some embodiments, the combined photometric distribution can be primarily above horizontal. For example, more than 75%, 80%, 85%, 90%, 95%, or 100% of the combined photometric distributions can be directed above horizontal.

Primary optical subsystem 106 can provide light with a number of different characteristics in addition to the photometric distribution. In some embodiments, primary optical subsystem 106 can provide light with more luminous flux than the secondary optical subsystem. In other embodiments, primary optical subsystem 106 can provide mostly white light. For instance, primary optical subsystem 106 can provide light with various spectral characteristics similar to various white light sources that are commonly available. Primary optical subsystem 106 can provide light that varies in time according to, or suggestive of, various environmental conditions such as, for example, the time of day, the day of the year, etc. Primary optical subsystem 106 can include a plurality of LEDs of various colors and/or white LEDs of various color temperatures. Primary optical subsystem 106 can also include an optical element that distributes the light according to the photometric distribution shown in FIG. 1.

Secondary optical subsystem 107 can also provide light with a number of different characteristics in addition to the photometric distribution. In some embodiments, secondary optical subsystem 107 can provide light with less luminous flux than primary optical subsystem 106. In other embodiments, the secondary optical subsystem can provide light that is substantially distributed horizontally and/or downwardly from the cavity such that the light is occupant observed and/or side viewed. In other embodiments, the secondary optical subsystem can provide light of various colors, brightness gradients, and/or effects. In some embodiments, the secondary optical subsystem can provide light with a specific or potentially user specified ambiance; for example, with various mood or thematic colors, or to be suggestive of natural light or a view of the sky, etc.

In yet other embodiments, the primary and/or secondary optical subsystem can provide light that varies according to any number of conditions such as, for example, the time of day, the day of the year, the season, the geographic location, the local weather conditions, user input, presence detection, music being played in the architectural space, etc. In some embodiments, secondary optical subsystem can provide various luminance and/or chromatic gradients across the aperture of the wall recessed luminaire as viewed by a user. In some embodiments, both the primary optical subsystem and the secondary optical subsystem can provide various luminance and/or chromatic gradients in conjunction with one another. For example, to simulate the passage of a cloud across the aperture, the primary optical subsystem can provide less light and/or different colors while the secondary optical subsystem can provide a different color scheme.

As noted above, in various embodiments, primary optical subsystem 106 and secondary optical subsystem 107 can provide light with a number of different characteristics. In some embodiments, primary optical subsystem 106 can be tailored to illuminate architectural space 150 with light having characteristics that are different than the characteristics of light provided by secondary optical subsystem 107.

In some embodiments, primary optical subsystem 106 can direct light upwardly to indirectly illuminate architectural space 150 and secondary optical subsystem 107 can direct light horizontally and/or downwardly in a diffuse manner to directly illuminate architectural space 150. Moreover, primary optical subsystem 106 can illuminate architectural space 150 with more light (e.g., provide light with more lumens and/or energy). In some embodiments, primary optical subsystem 106 can contribute more than 50% of the total light output of luminaire 105. In some embodiments, the primary optical subsystem can provide over 70%, 75%, 80%, 85%, 90% or 95% of the total light output of luminaire 105. And, in some embodiments, primary optical subsystem 106 can illuminate architectural space 150 with primarily white light, while secondary optical subsystem 107 can illuminate architectural space 150 with light having more color than primary optical subsystem 106. In some embodiments, primary optical subsystem 106 may partially illuminate the architectural space downward or horizontal.

In some embodiments, secondary optical subsystem 107 can provide light with qualities that are suggestive of natural light or a view of the sky through a window, portal, or translucent architectural element (e.g. glass block). In still further embodiments, the secondary optical subsystem may produce an illusion of depth or a perception of ambiguous depth within the aperture when viewed by an occupant of the architectural space. Moreover, secondary optical subsystem 107 can provide a lit appearance, direct view color and/or color gradients, direct view luminance and/or luminous gradients, and/or lighting for ambience.

In some embodiments, the color, brightness and/or distribution provided by secondary optical subsystem 107 and/or primary optical subsystem 106 can change over time. These changes can occur based on a program executed by a controller coupled with the light sources that modifies the lighting parameters over time.

In some embodiments, a program can operate to control the lighting parameters of a number of luminaires in use together. Moreover, any number of programs can be used. For example, a program can operate the lights to simulate daylight. Moreover, the program can change the light parameters throughout the day to simulate the sun passing through the sky. Such a program, for example, can vary based on the geographic location of the luminaire in use. As another example, a program can operate the lights to simulate a cloud passing overhead. Any number of sky patterns can be used. In some embodiments, the program can include sunset and sunrise simulations.

In some embodiments, a program can operate a luminaire to change its color presentation over time. This can include, for example, changing various color patterns within the full spectrum of color or changing the saturation of a given color or the brightness. In some embodiments, a program can operate to change colors across an array of luminaires. In this way, different luminaires can provide different color at different times. Moreover, the saturation of a color can change over time within one luminaire or across multiple luminaires. The brightness can also change across multiple luminaires.

In some embodiments, a program can change dynamically over time or in response to certain inputs. These inputs can include time of day, flipping of a switch, proximity detection, temperature, humidity, cloud conditions, time of year, etc.

In some embodiments, the vertical and/or horizontal luminous presentation (or light gradient) of the luminaire can change over time. This can include changing any number of characteristics of the light, such as the brightness, color, hue, saturation, etc. across the luminaire. This can also include changing a color profile vertically and/or horizontally across the luminaire. This can be accomplished, for example, by varying the characteristics of the top and bottom LEDs differently over time and/or varying the characteristics of left and right LEDs differently over time.

In some embodiments, front optical element 110 includes one or more panes of glass or other transmissive, translucent, or transparent material (e.g., plastic, Plexiglas, etc.). In some embodiments, front optical element 110 can include multiple layers, materials or elements, and/or may have properties related to the reflection, refraction, scattering, or diffusion of light. In some embodiments, front optical element 110 can cover the entire front of the luminaire 105. In other embodiments, front optical element 110 can include multiple panes that cover portions of the aperture within wall 115. In some embodiments, front optical element 110 can be translucent or hazy; can include glazing that provides the look of a transom window, clearstory and/or glass block; and/or can include an optical filter that allows light to pass with wavelengths that simulate the spectral profile (color) or brightness of daylight. And in yet other embodiments of the invention, front optical element 110 may be omitted.

Figure 2:
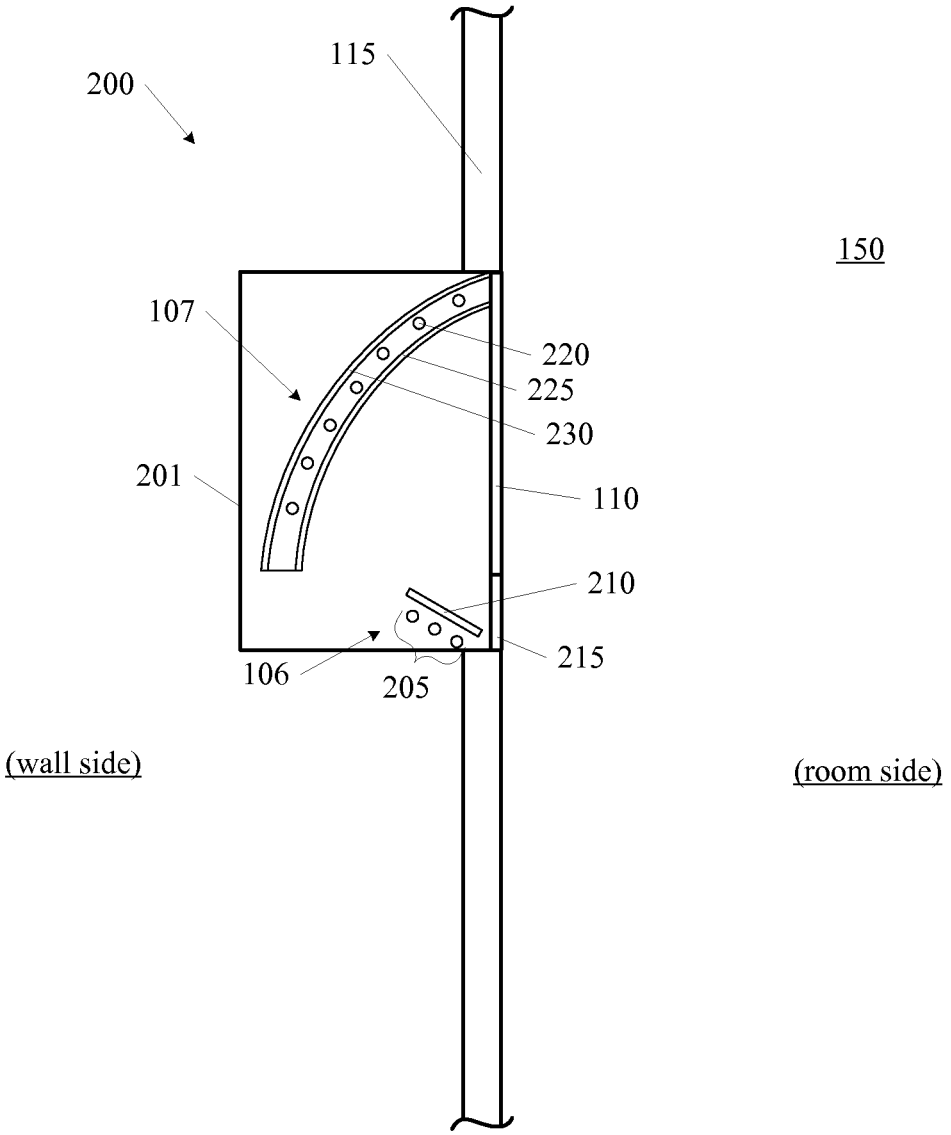
FIG. 2 shows a cross section of a backlit, wall recessed luminaire according to some embodiments of the invention.

FIG. 2 shows a cross section of a backlit luminaire 200 according to some embodiments of the invention. In this embodiment, primary optical subsystem 106 is shown to include a plurality of LEDs 205 and optical element 210 disposed within luminaire housing 201. Optical element 210 can focus, direct, and/or control the dispersion, direction and/or angle of the light from the LEDs. For example, optical element 210 can direct light emitted from LEDs 205 upwardly (e.g., toward the ceiling) within architectural space 150.

In this embodiment, secondary optical subsystem 107 is a backlit arrangement that includes a plurality of LEDs 220, reflective back surface 230, and translucent optical element 225 disposed within luminaire housing 201. A translucent optical element 225 may or may not be curved along either or both a vertical or horizontal profile. LEDs 220 can illuminate the architectural space through translucent optical element 225. Translucent optical element 225 can include a diffuser; one or more layers, materials or elements; and/or have properties related to the reflection, refraction, scattering, or diffusion of light. In some embodiments, translucent optical element 225 is a translucent film. Some light emitted from LEDs 220 can be directed toward translucent optical element 225. The light is diffusely scattered, and/or directed horizontally and/or downwardly into architectural space 150 by translucent optical element 225. Other light emitted from LEDs 220 can be reflected from reflective back surface 230 and diffusely scattered, and/or directed horizontally and/or downwardly into architectural space 150 by translucent optical element 225. LEDs 205 and/or LEDs 220 can include a plurality of LEDs (or other light sources, such as an OLED panel or sheet in place of LEDs 220 and either with or without the inclusion of reflective back surface 230 or translucent optical element 225) disposed horizontally along the length of the luminaire wall (into the page).

In some embodiments, light from both primary optical subsystem 106 and secondary optical subsystem 107 can illuminate the architectural space from the same cavity within wall 115 and/or through front optical element 110. In other embodiments, the luminaire may not include a front optical element 110. In some embodiments, shade 215 can be positioned to block the view of the interior of the luminaire, including the primary and/or secondary optical subsystems. Shade 215 can be positioned near the bottom of the aperture within which the luminaire is placed to shield the view of the interior of the luminaire from below or from the horizontal and/or can comprise non-translucent or non-transparent material. Shade 215 can have a finish similar to the rest of the wall, and/or be finished with the wall to have a seamless appearance.

Figure 3:
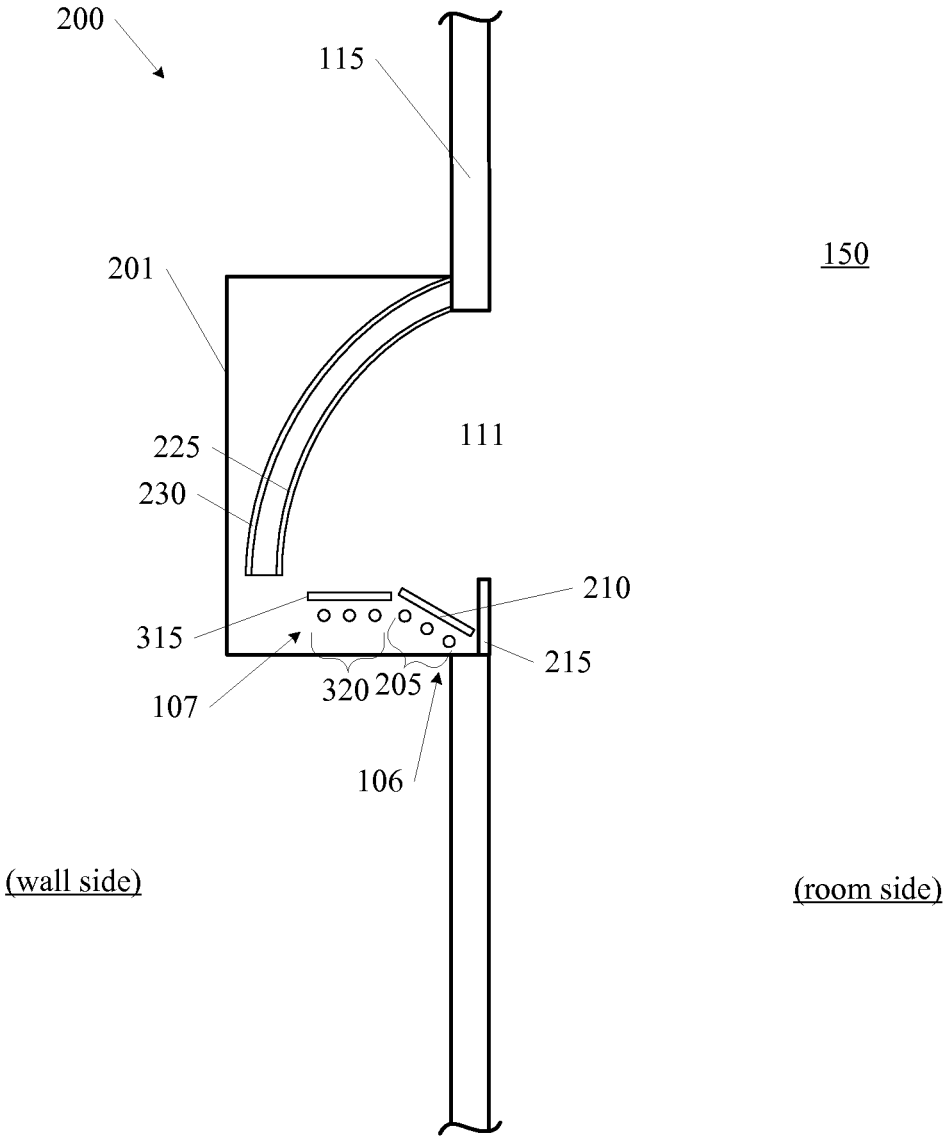
FIG. 3 shows a cross section of a wall recessed luminaire according to some embodiments of the invention.

FIG. 3 shows a cross section of luminaire 200 according to some embodiments of the invention. This luminaire 200 can fit within a single cavity in wall 115. In some embodiments, primary optical subsystem 106 can include a plurality of LEDs 205 and optical element 210 arranged to illuminate the ceiling of the architectural space. For example, optical element 210 can direct light emitted from LEDs 205 upwardly (e.g., toward the ceiling) within architectural space 150. In this embodiment, there is no front optical element. In this embodiment, aperture 111 provides an opening within wall 115. Light from the primary and secondary light sources exits the luminaire through aperture 111. Aperture 111 can include any number of configurations that allows the light from primary optical subsystem 106 and secondary optical subsystem 107 to exit the housing and pass through wall 115. Aperture can include any opening within the luminaire housing and the wall.

Secondary optical subsystem 107 can include a front-lit arrangement that includes a plurality of LEDs 320, reflective back surface 230, and/or translucent optical element 225. In some embodiments, only reflective back surface 230 is used. Moreover, various other reflective, translucent, or other surfaces and/or materials can be used. Furthermore, in some embodiments, reflective back surface 230 can be specular and/or diffusing. Most of the light emitted from LEDs 320 is directed toward translucent optical element 225 and/or reflective back surface 230 by optical element 315. Some of the light can then be reflected into architectural space 150 from translucent optical element 225, while other light can pass through translucent optical element 225 and be reflected off reflective back surface 230, and directed into architectural space 150 through translucent optical element 225. Either or both reflective back surface 230 and translucent optical element 225 can be shaped to direct light downwardly and/or horizontally into architectural space 150. For example, reflective back surface 230 and/or translucent optical element 225 can be shaped and/or angled in various ways to control the direction of the light, have particular color or luminance gradients, and/or have optical properties that achieve this directionality. Optical element 315 can focus, control, diffuse, and/or direct light toward reflective back surface 230 and translucent optical element 225.

LEDs 205 and/or LEDs 220 can include a plurality of LEDs (or other light sources) disposed horizontally along the length of the luminaire wall (into the page).

Figure 4:
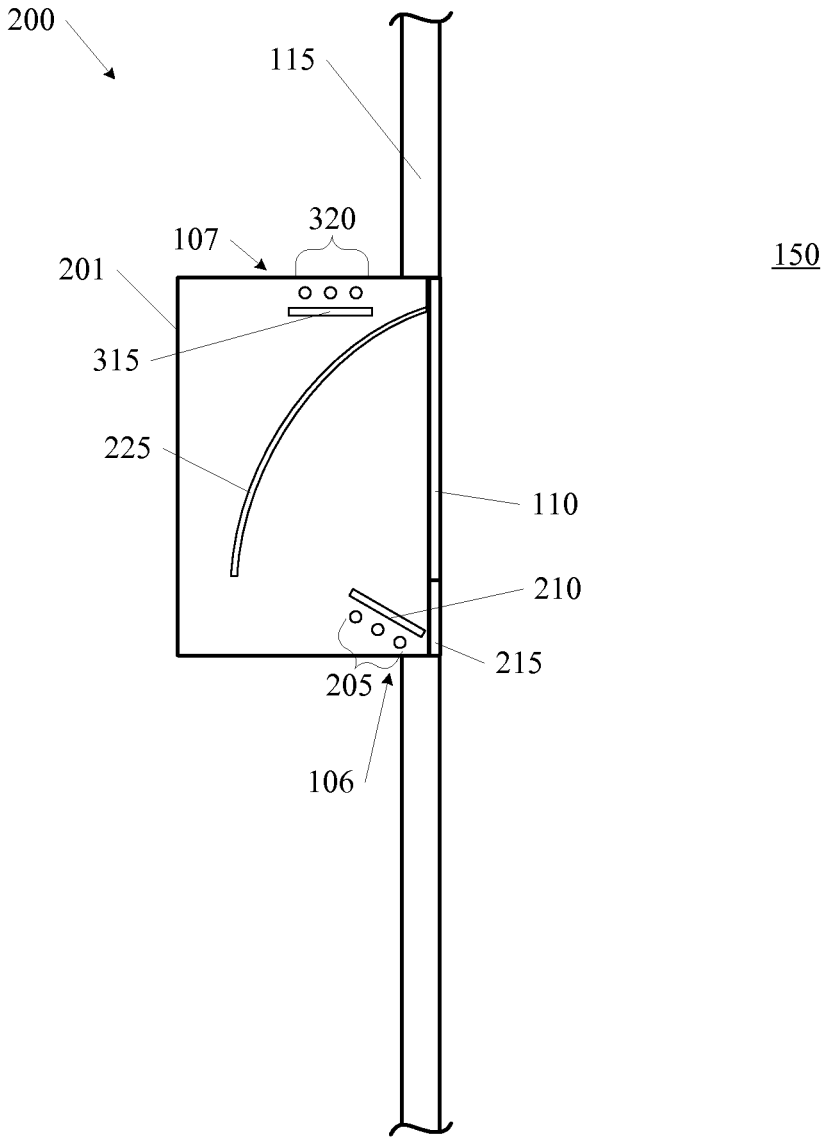
FIG. 4 shows a cross section of a wall recessed luminaire according to some embodiments of the invention.

FIG. 4 shows a cross section of luminaire 200 according to some embodiments of the invention. Luminaire components are disposed within luminaire housing 201. In this embodiment, secondary optical subsystem 107 is moved behind translucent optical element 225. In some embodiments, a reflective back surface (like 230) can be included elsewhere within luminaire 200. In other embodiments, reflective back surface 230 is not used in luminaire 200.

Figure 5:
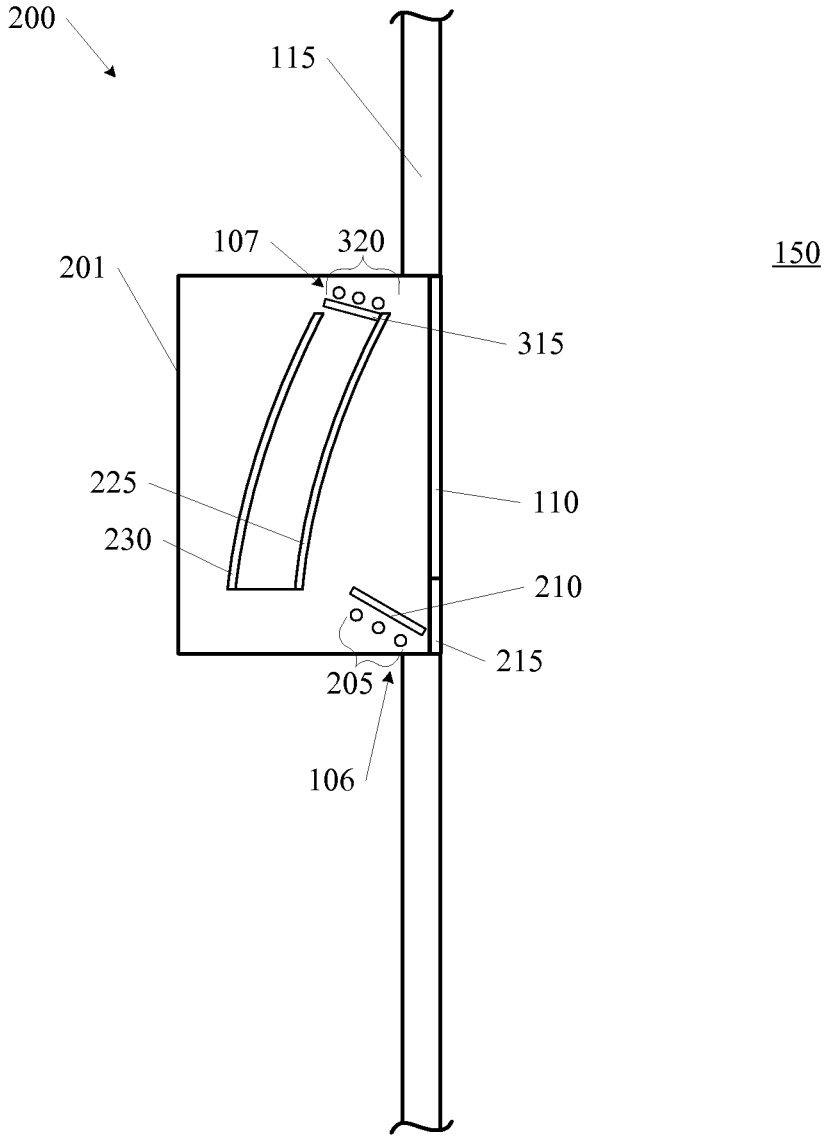
FIG. 5 shows a cross section of a wall recessed luminaire according to some embodiments of the invention.

FIG. 5 shows a cross section of luminaire 200 according to some embodiments of the invention. Luminaire components are disposed within luminaire housing 201. In this embodiment, secondary optical subsystem 107 is moved to provide light between translucent optical element 225 and reflective back surface 230.

Figure 6:
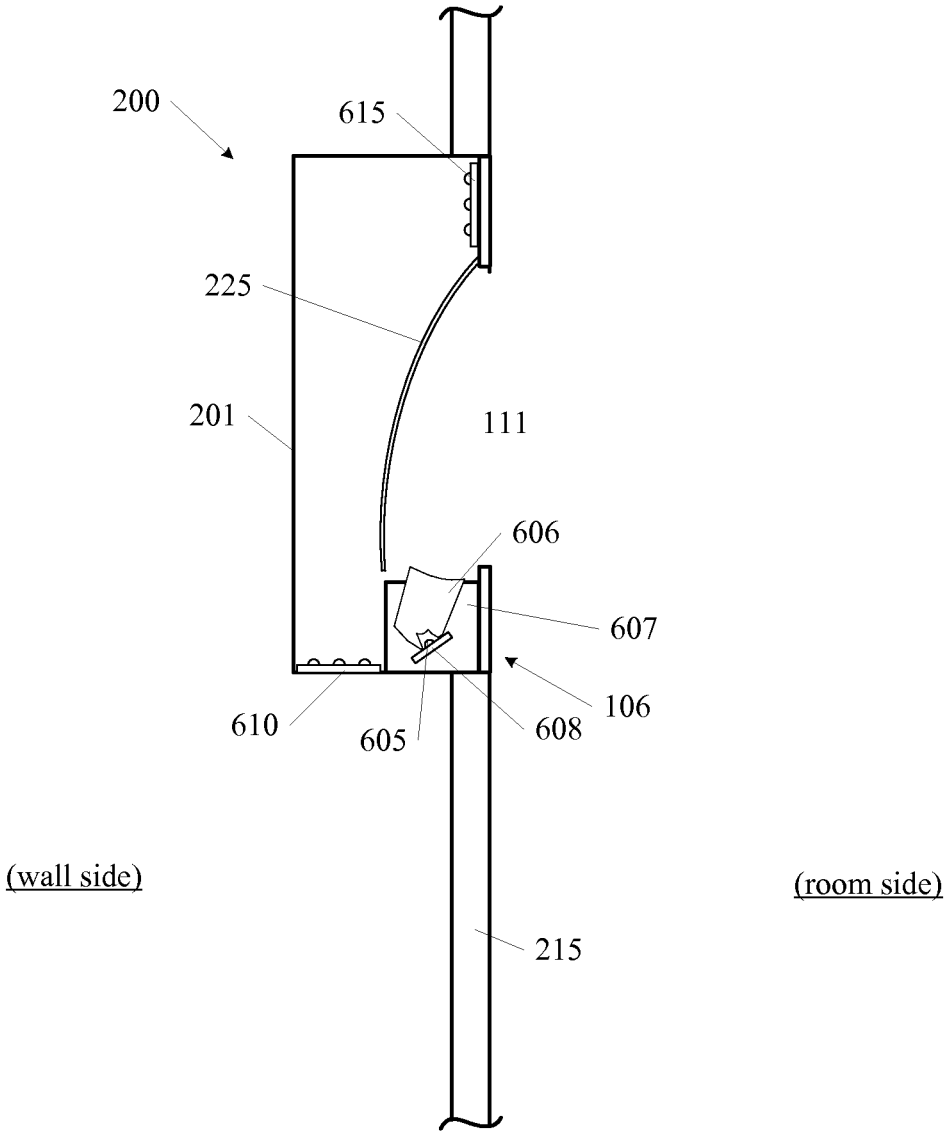
FIG. 6 shows a cross section of a backlit wall recessed luminaire according to some embodiments of the invention.

FIG. 6 shows a cross section of luminaire 200 according to some embodiments of the invention. Luminaire components are disposed within luminaire housing 201. Primary optical subsystem 106 is disposed position located inwardly within the housing relative the bottom peripheral edge of aperture 111 and proximate the inwardly facing surface of housing. In some embodiments, primary optical subsystem 106 can include a plurality of white or substantially white LEDs 605, circuit board 608, lens 606, and/or heat sink 607.

Secondary optical subsystem 107 can include a number of secondary light sources. For instance, secondary optical subsystem 107 can include LEDs 610 disposed above and/or below aperture 111. LEDs 610 may also be positioned to direct light upwards behind translucent optical element 225.

Secondary optical subsystem 107 can also include LEDs 615 positioned within the housing at a level above the top portion of aperture 111 near a peripheral edge of aperture 111 and can direct light inwardly toward the back surface of housing 201. The light from LEDs 610 and 615 can mix within housing 201 prior to passing through translucent optical element 225 and exiting through aperture 111. LEDs 615 and 610 can include a plurality of LEDs, for example, of one or more colors depending on the application.

Figure 10:
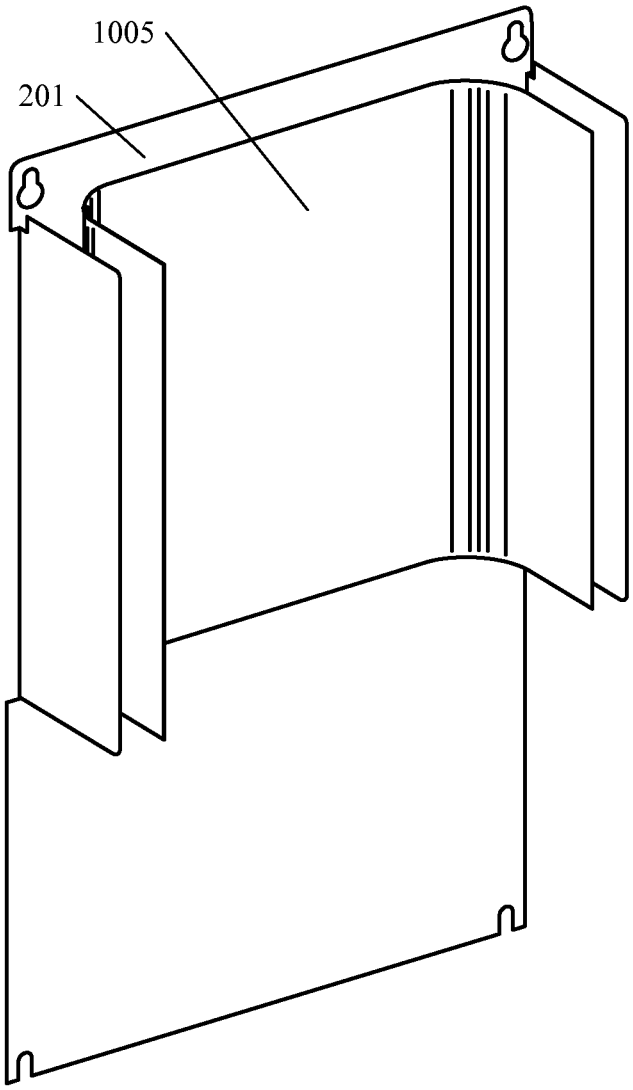
FIG. 10 shows a back panel with a reflective insert according to some embodiments of the invention.

Luminaire 200 can also include a reflective back surface or reflective insert 1005 of housing 201 as shown in more detail in FIG. 10. This reflective back surface of housing 201 can be part of the luminaire body or an insert within the luminaire body. A reflective surface on the back of housing 201 can reflect light from LEDs 610 and LEDs 615 toward translucent optical element 225. LEDs may also be positioned on the side of translucent optical element 225. In some embodiments, housing 201 can be coated or made from any type of reflective material that allows the light from various secondary light source LEDs to mix within the body of luminaire 200 prior to passing through translucent optical element 225 and then exiting luminaire 200.

Figure 7:
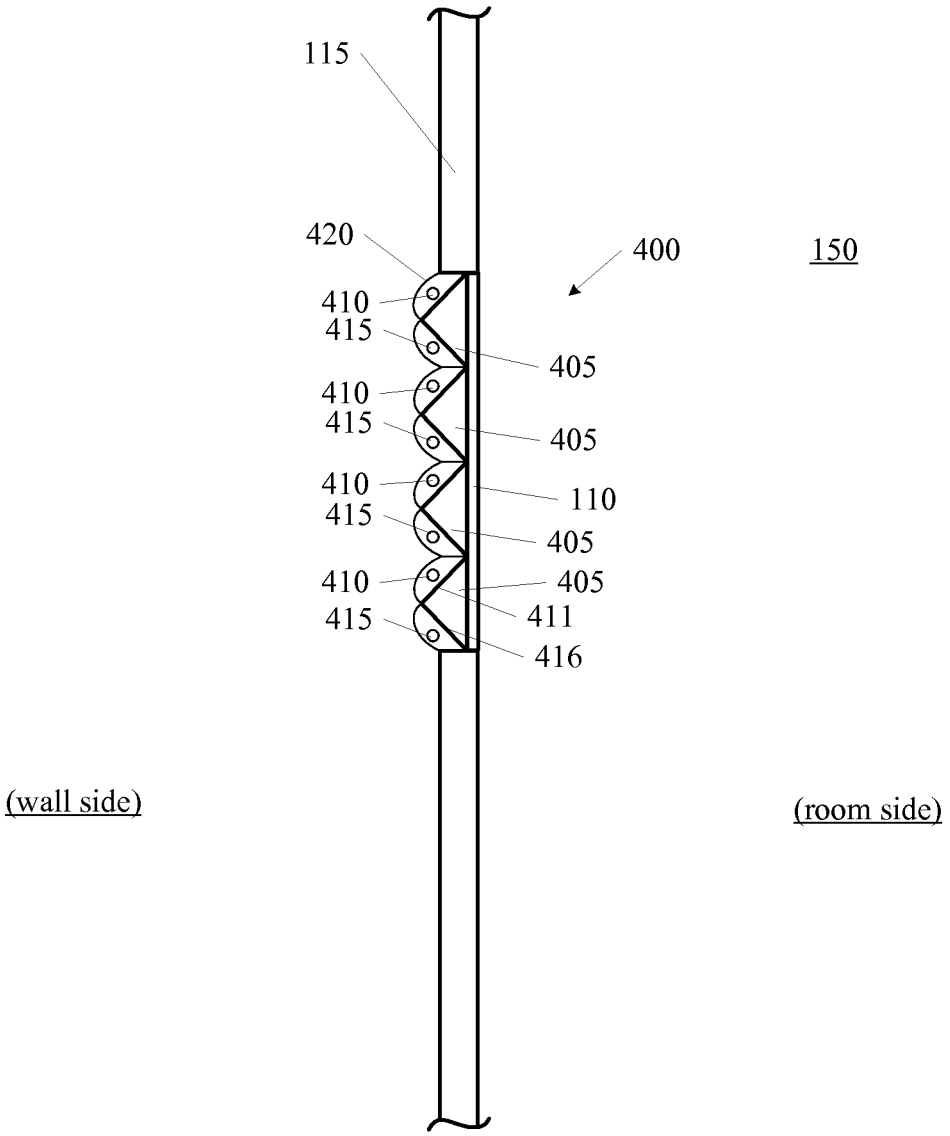
FIG. 7 shows a cross section of a wall recessed luminaire according to some embodiments of the invention.

FIG. 7 shows a cross section of recessed luminaire 400 according to some embodiments of the invention. Recessed luminaire 400 can fit within a cavity located within wall 115. Recessed luminaire 400 can include a plurality of elongated prisms 405 that extend horizontally (into the page) and are disposed one on top of another vertically. Each prism 405 has a triangular cross section that can be equilateral, isosceles, and/or scalene. The prisms can vary in size, shape, dimension, angle and/or curvature. In some embodiments, each prism 405 can be arranged relative to one another such that one of the surfaces of each prism 405 forms a plane with one of the surfaces of other prisms 405.

Primary optical subsystem LEDs 415 can be positioned behind each prism (opposite the architectural space 150) below the apex of prism 405. In this configuration, light from primary optical subsystem LEDs 415 will pass through prism 405 toward the ceiling as shown by primary photometric distribution 125 in FIG. 1. The direction, size, and/or shape of the photometric distribution from primary optical subsystem LEDs 415 through prism 405 can vary depending on the shape of prisms 405.

Secondary optical subsystem LEDs 410 can be positioned behind each prism (opposite the architectural space 150) above the apex of prism 405. In this configuration, light from secondary optical subsystem LEDs 410 will pass through prism 405 downwardly and/or horizontally into the architectural space as shown by secondary photometric distribution 120 in FIG. 1. The direction, size, and/or shape of the photometric distribution from secondary optical subsystem LEDs 410 through prism 405 can vary depending on the shape of prisms 405.

In some embodiments, prisms 405 can be shaped to change the photometric distribution of light. For example, surface 416 of the prisms 405 nearest LEDs 415 can be shorter than surface 411 nearest LEDs 410. In this configuration, light from LEDs 415 can be directed upwardly at a steeper angle and light from LEDs 410 can be directed more horizontally. In some embodiments, the curvature of the prism faces can be changed to change the direction of the light. Various other sizes, dimensions, and/or angles can be used to change the direction, and/or angle of the light from LEDs 410 and 415. In some embodiments, the various prisms can have different shapes in order to provide a varied photometric distribution.

In some embodiments, front optical element 110 may not be used or it may be part of prisms 405. While four elongated prisms are shown, any number of prisms may be used. In some embodiments, reflective cover 420 can surround secondary optical subsystem LEDs 410 and/or primary optical subsystem LEDs 415 and reflect light into prisms 405.

Moreover, while each prism is shown associated with a single primary optical subsystem LED 415 and a single secondary optical subsystem LED 410, in some embodiments, multiple prisms can be associated with a primary optical subsystem and/or a secondary optical subsystem. In other embodiments, a single prism can be associated with a plurality of light sources. And, in some embodiments, secondary optical subsystem LEDs 410 and/or primary optical subsystem LEDs 415 can represent a plurality of light sources arranged horizontally along the elongated prism. In some embodiments, a diffuser (not shown) may be placed between secondary optical subsystem LEDs 410 and prisms 405 as well as between primary optical subsystem LEDs 415 and prisms 405. Such diffusers can spread the light across the prism to provide a horizontally uniform light presentation and/or mix colors from various light sources. In some embodiments, a diffuser can be placed between the prisms 405 and front optical element 110.

Figure 8:
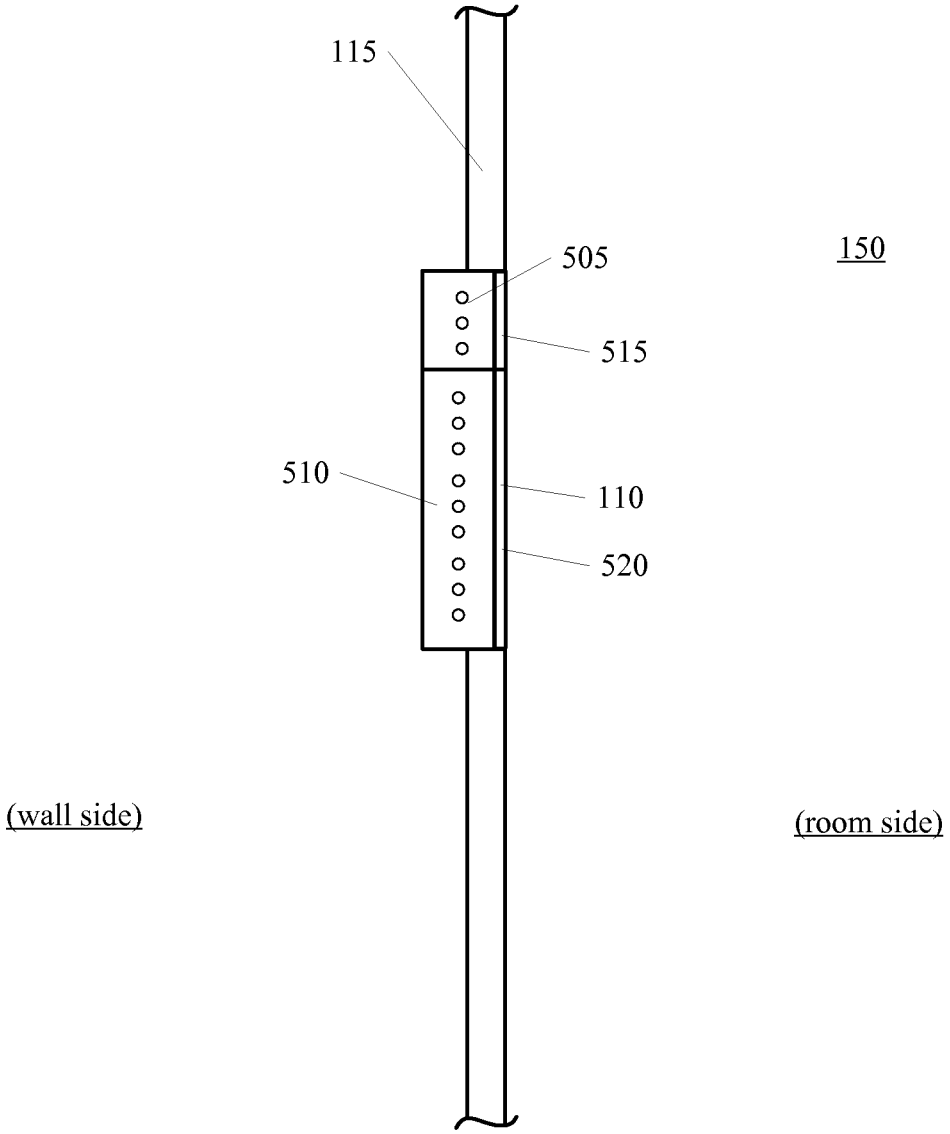
FIG. 8 shows a cross section of a wall recessed luminaire according to some embodiments of the invention.

FIG. 8 shows another embodiment of a wall recessed luminaire. In this embodiment, primary optical subsystem 505 can be located within wall 115 above secondary optical subsystem 510. Primary optical subsystem 505 can include a plurality of LEDs or other light sources. Primary optical subsystem 505 in conjunction with primary optical element 515 (e.g., lens, diffuser, etc.) can direct light toward the ceiling, for example, according to primary photometric distribution 125 of FIG. 1. Secondary optical subsystem 510 in conjunction with secondary optical element 520 (e.g., lens, diffuser, etc.) can direct light horizontally and/or downwardly, for example, according to secondary photometric distribution 120 of FIG. 1. Secondary optical subsystem 510 can include, for example, any type of display panel(s) such as an LCD, OLED, LED matrix, or plasma display. In some embodiments, this wall recessed luminaire can include a plurality of LEDs. Various other geometric arrangements are possible. For example, the primary and/or secondary subsystems can be disposed in different locations in, on, and/or around aperture 111.

Figure 9:
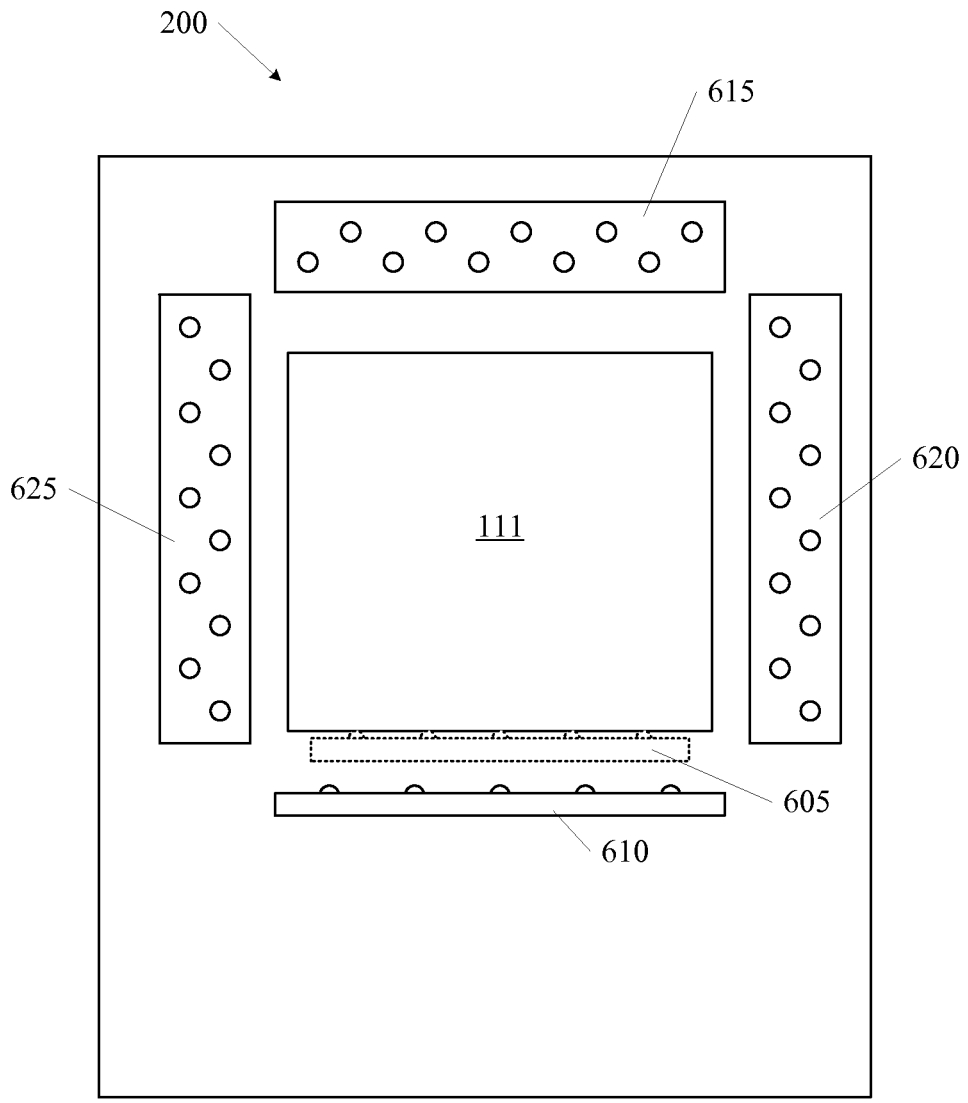
FIG. 9 shows a back view of a luminaire according to some embodiments of the invention.

A back view of luminaire 200 similar to that shown in FIG. 6, is shown in FIG. 9. This view shows luminaire 200 covering aperture 111. Translucent optical element 225, while not shown, can be positioned such that light from the various light sources can pass through translucent optical element 225 prior to exiting the luminaire through aperture 111. Primary optical subsystem LEDs 605 can be positioned in front of translucent optical element 225. In this embodiment, the secondary light source includes four LED sources. These include LEDs 615 and LEDs 610 positioned as shown in FIG. 6. Secondary light source also includes LEDs 620 and 625 positioned on the sides of translucent optical element 225. Any of the LEDs 610, 615, 620, and 625 can be independently controlled.

The LEDs that make up either or both primary or secondary optical subsystems can include any type, color, size, etc. of LED known in the art. Any configuration or arrangement of LEDs can be used as shown in the various embodiments of the invention. The LEDs can be disposed on a circuit board and may include optical elements such as lens placed on or near the LEDs on the circuit board as shown, for example, in FIGS. 15 and 16. Each of the secondary light source LEDs can be independently controlled and/or operated to produce various effects.

In some embodiments, LEDs 620 or 625 can be controlled to create light gradient across translucent optical element 225 when viewed from the outside. For instance, LEDs on one side can provide light having one color and LEDs on the other side may provide light of another color. In this way, the presented illumination can vary horizontally across the luminaire. Similarly, LEDs 615 and LEDs 610 can provide a similar effect in the vertical direction. Moreover, a combination of vertical and horizontal gradients can be provided.

LEDs 610, 615, 620, and 625 may produce light that is reflected off of the back panel of housing 201 or reflective insert 1005 shown in FIG. 10. Reflective insert 1005 can be made from any highly reflective material (e.g., White Optics™ 97). Reflective insert 1005 can also be made from a material that is diffusely reflective. The corners of reflective insert 1005 can have radii large enough to eliminate corner shadow.

In some embodiments, the back surface and/or side surfaces of housing 201 may be reflective and in such embodiments, reflective insert 1005 may or may not be used. The reflective back surface and/or reflective side surfaces of housing 201 and/or reflective insert 1005 can produce a light mixing chamber within the body of the luminaire. Some light from secondary light sources can be mixed within the body of the chamber after being reflected off the back or side surfaces of housing 201 and/or reflective insert 1005 prior to exiting through translucent optical element 225 (such as described in conjunction with the embodiment shown in FIG. 6). Some light can also exit the translucent optical element 225 without interaction with reflective back surface of housing 201 and/or reflective insert 1005.

Figure 11A:
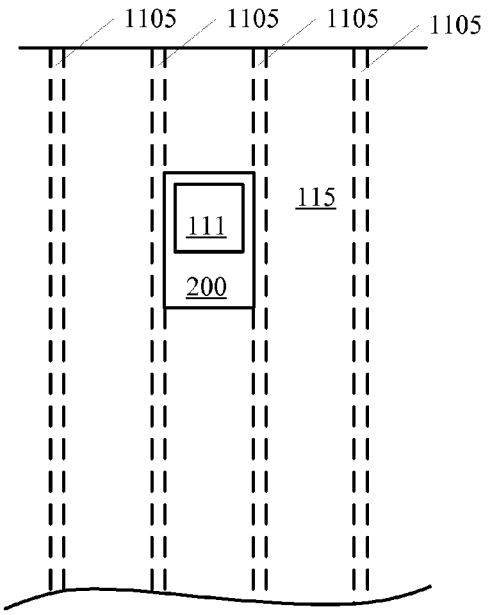
FIGS. 11A, 11B, 11C and 11D show examples of a wall recessed luminaire according to various embodiments of the invention from a wall facing perspective.

FIG. 11A shows luminaire 200 according to various embodiments of the invention from a wall facing perspective. As shown, luminaire 200 can fit in between two studs 1105 (e.g., 2×4 s or steel studs) within wall 115. Luminaire 200 can be recessed within the cavity in the wall between the two studs 1105. Aperture 111 is where light exits the luminaire into the architectural space. Aperture 111 can be any size. In some embodiments, aperture 111 can be 6 inches by 6 inches. The only that can be viewed by an individual.

Figure 11B:
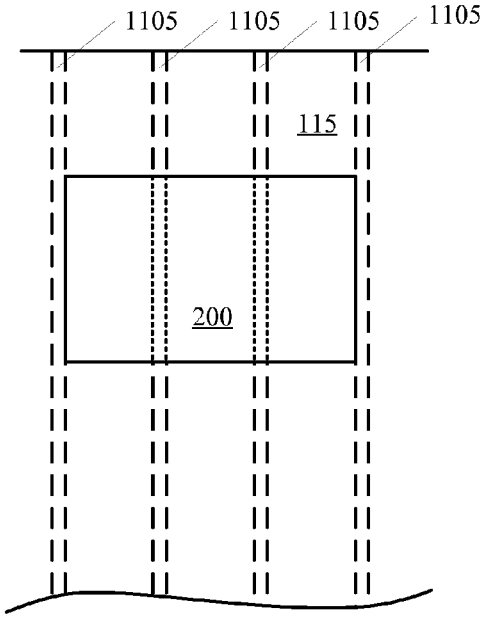

FIG. 11B shows luminaire 200 spanning multiple studs 1105. In some configurations, light sources, controllers, optics, power, etc. shown in any of the embodiments may be separated into subsystems that are recessed within the wall between studs 1105. A common front optical element or aperture can span the various subsystems providing a look and feel to the occupant of a single visual element.

Figure 11C:
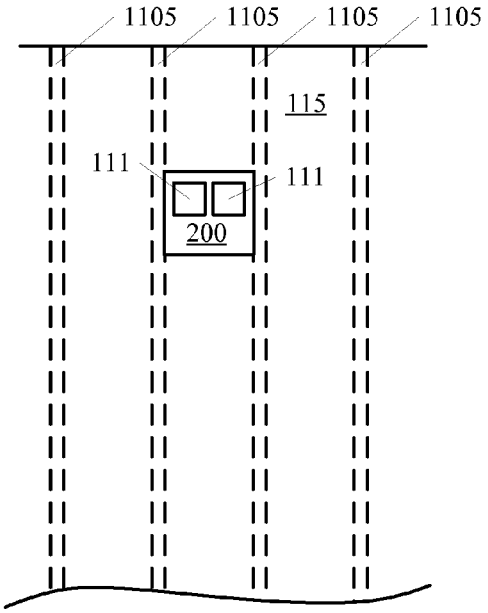

FIG. 11C shows a single luminaire 200 with two apertures 111 according to some embodiments of the invention. Separate or the same primary and secondary optical subsystems can illuminate the architectural space through both apertures. Luminaire 200 can fit between two studs 1105 within wall 115. Luminaire 200 can be recessed within the cavity in the wall between the two studs 1105. Apertures 111 can include optical systems that provide separate illumination profiles yet both fit within studs 1105. Apertures 111 can have any size that fits between studs 1105. In some embodiments, aperture 111 can be 12 inches by 12 inches or 6 inches by 6 inches.

Figure 11D:
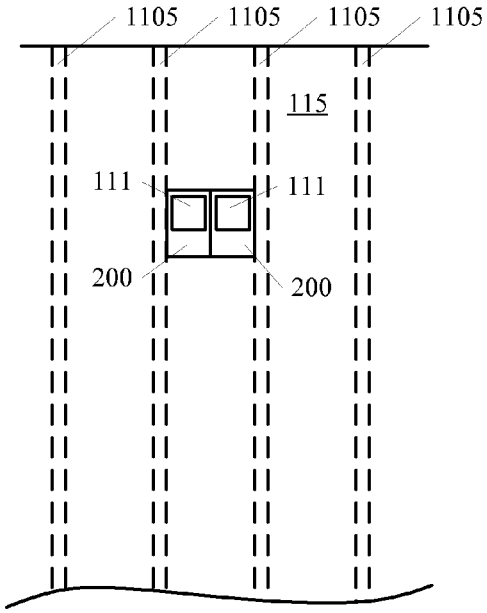

FIG. 11D shows two recessed luminaires 200 that each illuminate via one aperture are fit together between two studs according to some embodiments of the invention. Each luminaire 200 can include separate aperture 111. In some embodiments, aperture 111 can be 6 inches by 6 inches.

In some embodiments, custom wall framing may be used to impart a polished appearance to the installation. Custom wall framing members can extend horizontally above and below the housing(s) and spanning multiple cut vertical studs.

Figure 12A:
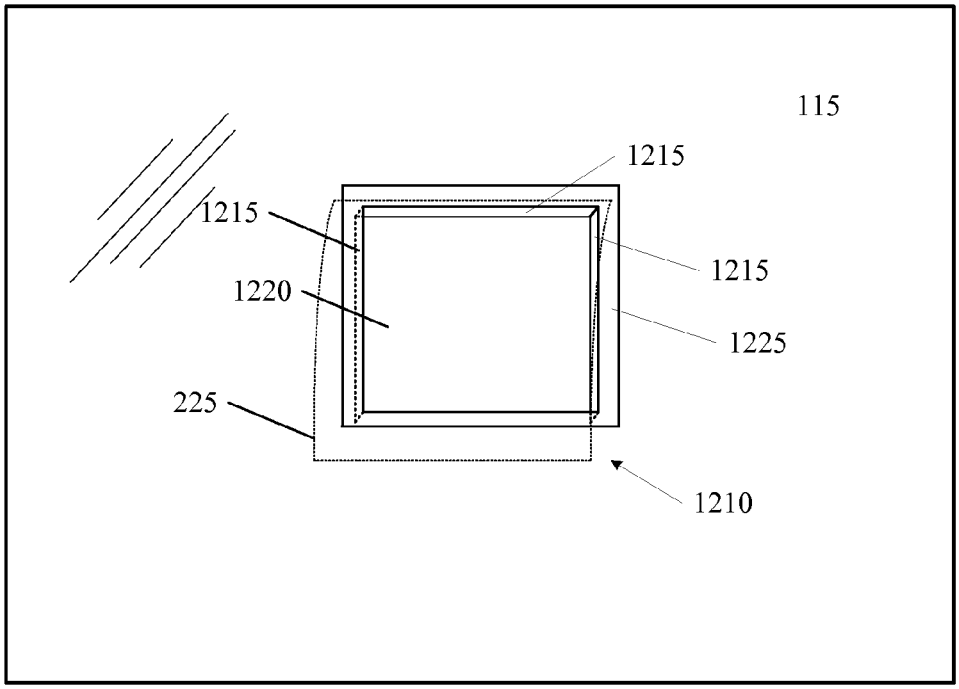
FIGS. 12A and 12B show front views of wall recessed housing according to some embodiments of the invention.
Figure 12B:
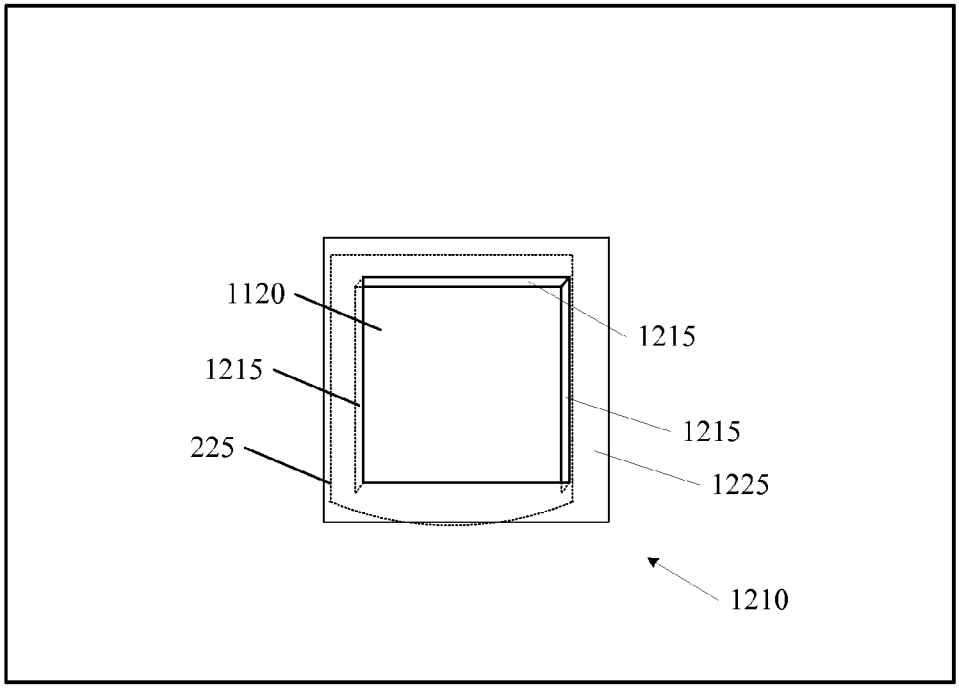

In some embodiments, the installation may include a trim piece, such as a frame 1210 that defines a frame opening 1220. The frame can be of any shape or design, for example, including, but not limited to, shapes or designs that are standard for window trim or picture frames. The frame may be integrally-formed with the luminaire housing or, alternatively, may be a separate trim piece (see FIGS. 13 and 14) that couples to the luminaire housing (or other structure) to ensure that the frame opening 1220 aligns with the wall aperture 111 so that light generated by the luminaire can exit through, or be visible within, the wall aperture 111. The thickness of the frame 1210 and the size of the frame opening 1220 can vary depending on the appearance desired for the installation. The frame 1210 may be positioned relative to the wall aperture 111 so that the front face 1225 of the frame is flush with the wall, inset back from the wall or extends over the wall beyond a wall aperture. For example, in some embodiments, the entirety of the frame 1210 is positioned within the wall aperture so that the front face 1225 of the frame 1210 is flush with the wall. The frame 1210 may have a contrasting appearance with the wall or may be finished to appear seamless with the wall. Alternatively, frame 1210 may have a thickness such that it extends along the wall beyond the wall aperture (thus giving the appearance of a picture frame or window). FIGS. 12A and 12B show front views of a luminaire housing according to some embodiments of the invention. In some embodiments, a luminaire can include frame 1210 that is flush with the wall and covers the perimeter of the wall-cavity that extends beyond the aperture. In other embodiments, frame 1210 extends over the wall and beyond the wall-cavity. Frame 1210, for example, can have thickness small enough and/or be made from a material that allows the wall and frame to have a finish or can be finished to appear seamless. A recessed luminaire can also include trim or a frame that is flush to the wall, inset from the wall or extends over the wall beyond the wall-cavity. The trim or frame can have any thickness and/or style. In some embodiments, the housing can include driver, power, and/or control logic.

In some embodiments, side surfaces 1215 (or insets) can extend backwardly from the frame 1210 into the wall cavity and/or into housing aperture 111. These side surfaces 1215 can frame portions of the wall aperture and/or luminaire aperture 111. In some embodiments, side surfaces 1215 can have a depth of 2.0, 1.75, 1.5, 1.25, 1.0, 0.75, 0.5, 0.25, etc. inches. The side surfaces 1215 can, but do not have to be, integrally formed with the frame 1210. These side surfaces 1215 can be finished to match the wall surface or have a clean architectural finish of their own. In some embodiments, depending on the location of various optical components, a wall recessed luminaire can include one, two, three, or four side surfaces 1215.

In one specific embodiment, three side surfaces 1215 can are provided on the frame 1210 within the aperture on the opposing sides and on the top of the frame. In some embodiments side surfaces 1215 provide depth to the installation (such as a window sill) and/or are used to shield from the view the internal components of the luminaire 200. In some embodiments, frame 1210 can be integral with side surfaces 1215. In some embodiments, LEDs or other optical components can be integrated within frame 1210 and/or side surfaces 1215.

FIG. 12A shows translucent optical element 225 having a vertical curve. FIG. 12B shows translucent optical element 225 having a horizontal curve. In yet other embodiments, translucent optical element 225 can have a curvature in both the vertical and horizontal directions. In some embodiments, translucent optical element 225 can also have a vertical and/or horizontal tilt relative to some axis. As shown in the figures, translucent optical element 225 can extend internally within the housing beyond the edges of the sides surfaces 1215 that extend inwardly into a wall aperture and luminaire housing aperture 111. In this way, the side surfaces 1215 can shield from view the edges of the translucent optical element 225 and the various components of both the first optical subsystem and the second optical subsystem.

In some embodiments, frame 1210 and/or side surfaces 1215 can be integral with the housing that is disposed within the wall. In other embodiments, frame 1210 and/or side surfaces 1215 can be part of separate outer inset that couples with the housing portion disposed within the wall. Such an inset is shown in FIG. 13.

In some embodiments, translucent optical element 225 can be collapsible, rollable, and/or flexible in order to be installed, replaced or removed through the aperture. In some embodiments, translucent optical element 225 may have slits, cuts, rivets, pegs, folds, flanges, wings, seams or gathers in order to provide the curvature and/or to fit within the housing. In some embodiments, translucent optical element 225 can be positioned within the housing without being coupled directly with the housing. In other embodiments, translucent optical element 225 can be coupled within the interior of the housing. In some embodiments, translucent optical element 225 can extend past the internal edges of side surfaces 1215 and/or can terminate near internal edges of the housing.

Figure 13:
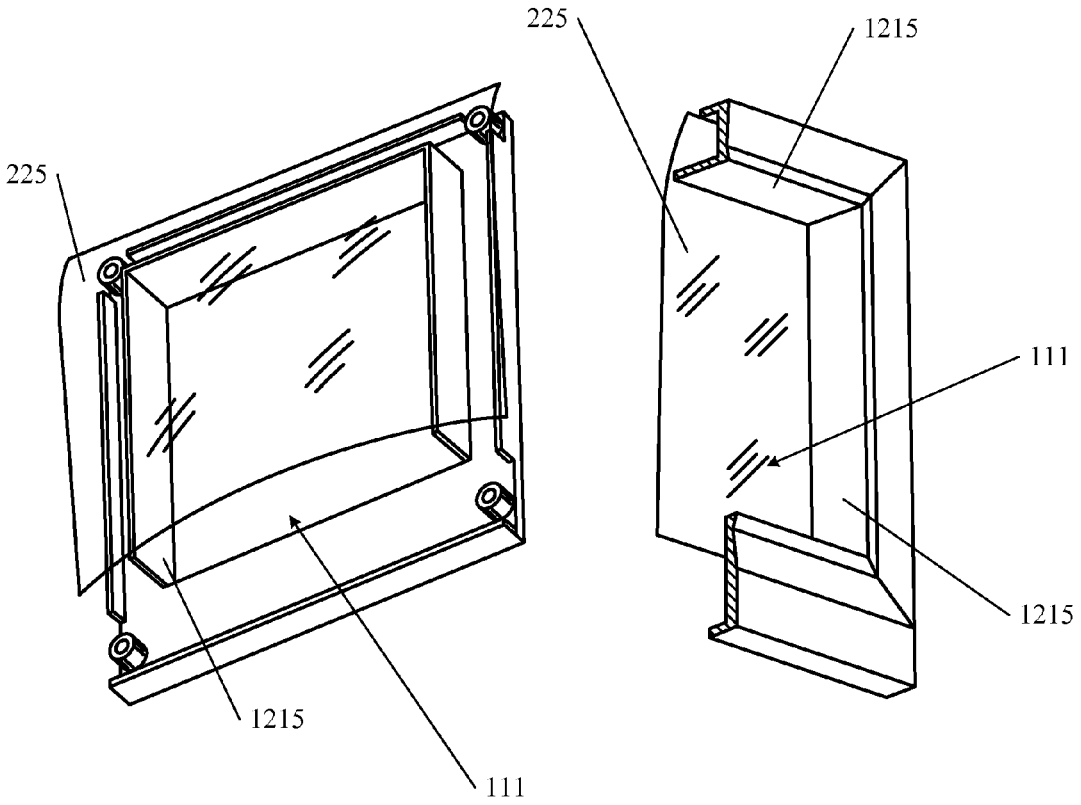
FIG. 13 shows a translucent optical element placed over aperture according to some embodiments of the invention.

FIG. 13 shows translucent optical element 225 placed over aperture 111 when viewed from within the housing or behind aperture 111, when viewed from the front of the housing. In some embodiments, translucent optical element 225 can be positioned within the body of the luminaire and may be positioned from the top of aperture 111 toward the bottom of aperture as shown in FIG. 6. Translucent optical element 225 may be positioned away from the bottom peripheral edge of aperture 111 (or the interior facing housing surface) in order to provide space for primary optical subsystem to illuminate the architecture space without exiting through translucent optical element 225. This arrangement can result in translucent optical element 225 having a concave shape and/or tilt along a horizontal axis.

In some embodiments, translucent optical element 225, for example, can be a translucent film. In some embodiments, a clear or diffuse covering (e.g. front optical element 110 shown in FIG. 1) can be used to cover aperture 111.

Figure 14:
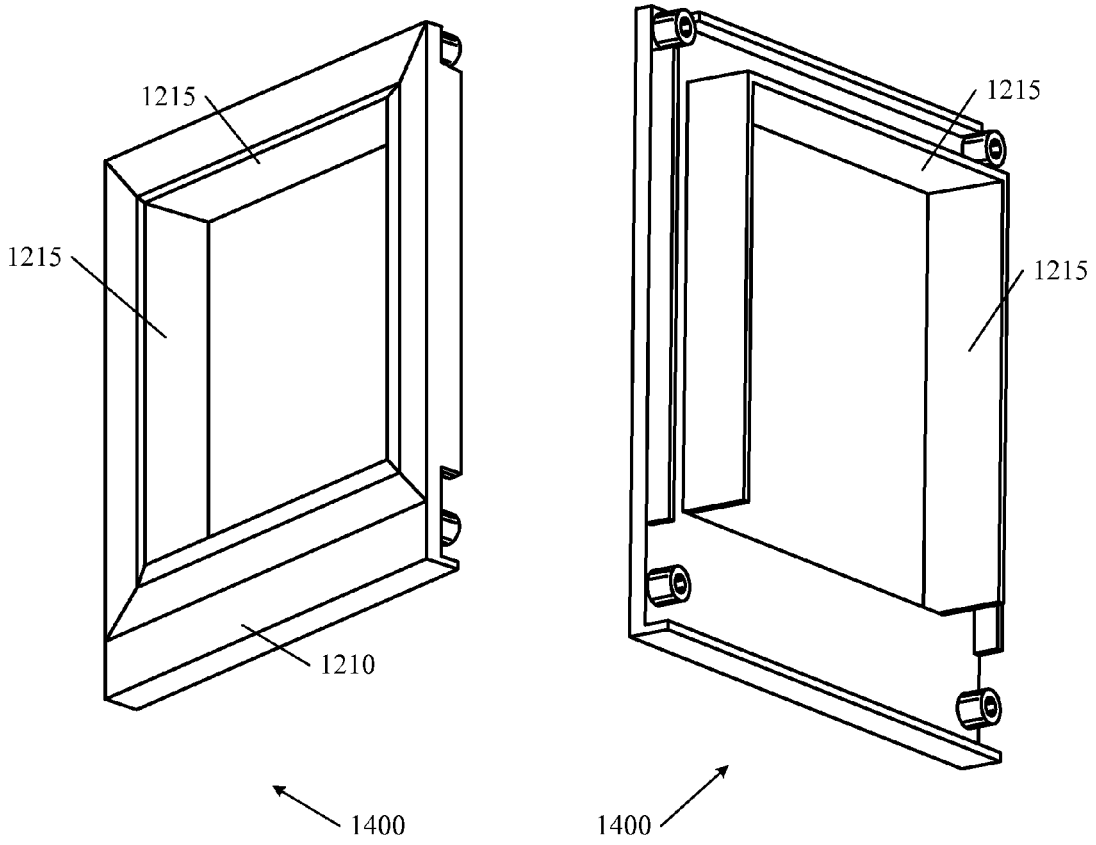
FIG. 14 shows an inset that can be added to the room side of the wall and coupled with the functional components of the luminaire disposed within a luminaire.

FIG. 14 shows inset 1400 (or aperture trim piece) that can be added to the room side of the wall and coupled with the functional components of the luminaire disposed within a luminaire. Inset 1400 can be positioned on the wall (or any other surface) so that the front surface of inset 1400 is flush or substantially flush with the surface of the wall. In some embodiments, inset 1400 can be flush with the wall while side surfaces 1215 extend inwardly into the housing through the wall. In some embodiments, inset 1400 can include side surfaces 1215 surrounding the top and sides of the aperture and extending inwardly into the aperture. Side surfaces 1215 can provide depth to the aperture. In some embodiments, inset 1400 does not include a lower recessed side surface. As shown in the figure, frames 1210 can be slightly recessed in order to provide an area to form into the wall, for example, with plaster or mud to create an effect where inset is flush with the wall. Moreover, side surfaces can have a depth of 2, 1.75, 1.5, 1.25, 1.0, 0.75, or 0.5 inches extending from the front surface of inset into the housing. In this way, the front edges of aperture 111 can be flush with the rest of the wall.

Some embodiments of the invention may not include inset 1400. In some embodiments, a frame can ring aperture 111 on the external surface of the wall like a picture frame. In some embodiments the frame may not be flush with the wall. The frame can take on any shape or design, for example, including shapes or designs that are standard for window trim or picture frames. Moreover, the frame may include side surfaces that extend inwardly into the housing through the wall.

Figure 15A:
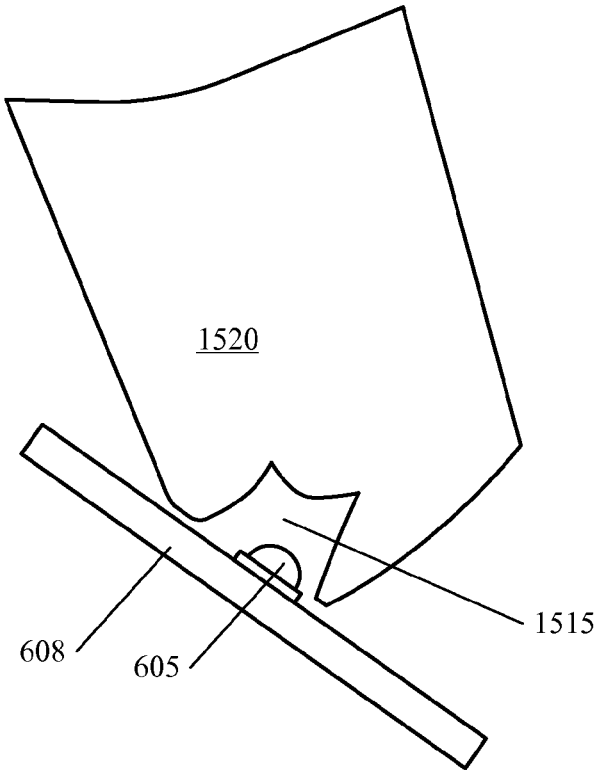
FIG. 15A shows a side-view of an LED circuit board arranged with a lens according to some embodiments of the invention.

FIG. 15A shows a side-view of an LED circuit board 608 arranged with lens 1520 according to some embodiments of the invention. LED circuit board 608 can include a plurality of LEDs 605 arranged in any geometric configuration on the circuit board 608. Any number of LEDs 605 can be arranged on the circuit board.

In some embodiments, lens 1520 can be coupled with circuit board 608. Lens 1520 can project light in an upward illumination distribution using a combination of refraction and total internal reflection. Lens 1520 can be used with primary optical subsystem 106. Lens 1520 includes pocket 1515 within which LEDs 610 are placed. In some embodiments, lens 1520 is positioned a small distance away from circuit board 608. For example, an injection molded plastic piece can be positioned between circuit board 608 and lens 1520 in order to provide thermal isolation. In some embodiments, lens 1520 can be secured a distance away from circuit board 608 using brackets or other mechanical means in order to provide thermal isolation.

Figure 17:
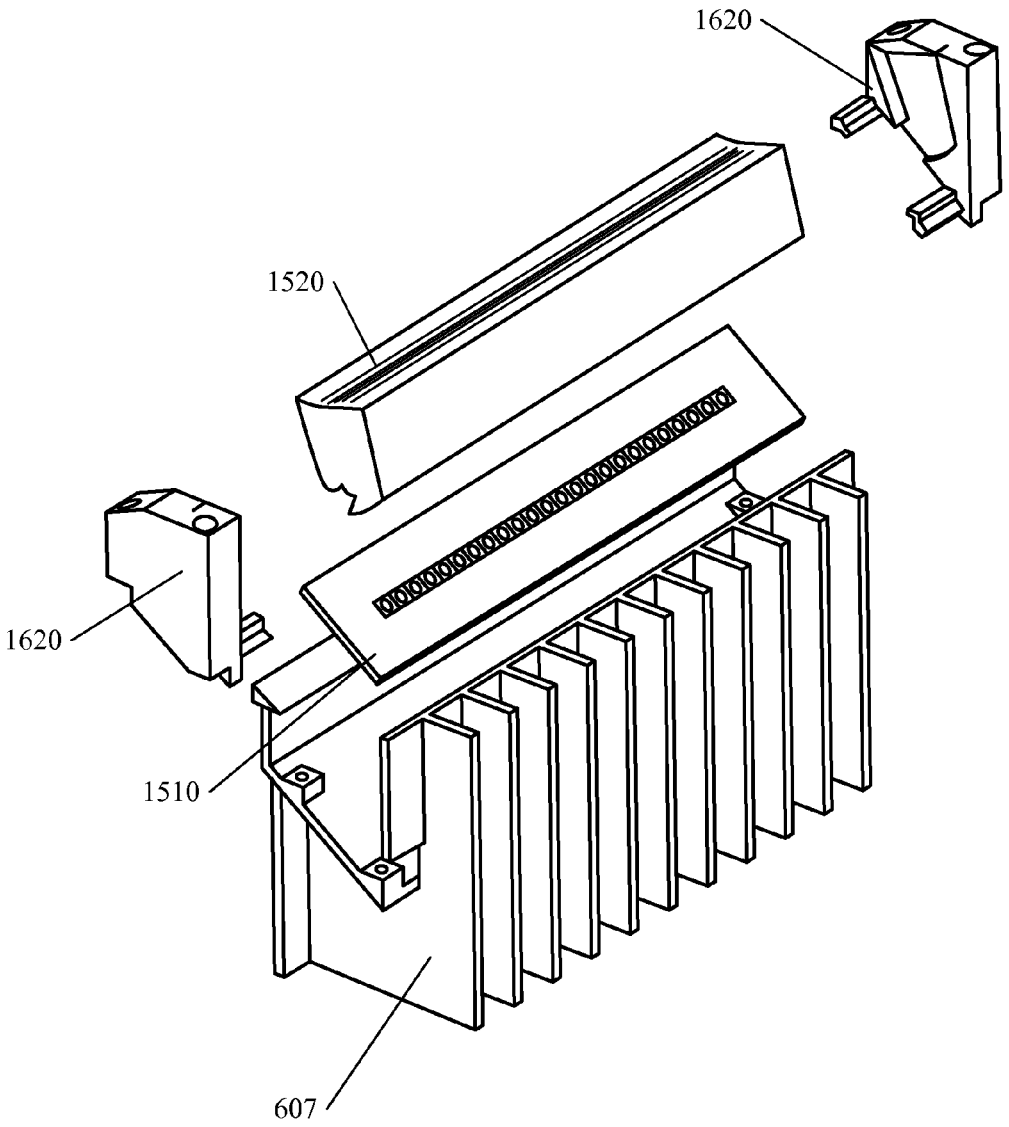
FIG. 17 shows an exploded view of portions of primary optical subsystem according to some embodiments of the invention.

As shown in FIG. 17, the LEDs may not extend all the way across circuit board 608. This is done to reduce the amount of light that is incident on side surfaces (e.g., side surfaces 1215 shown in FIGS. 12A, 12B and 13) of a recessed luminaire. In other embodiments, the LEDs can extend all the way along circuit board 608.

Figure 15B:
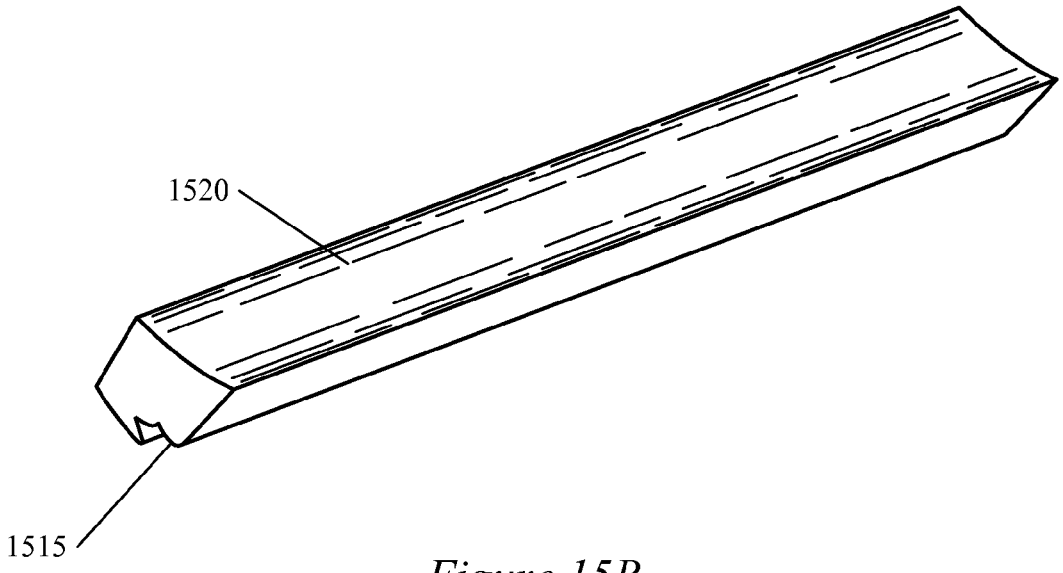
FIG. 15B shows a three dimensional view of a TIR lens according to some embodiments of the invention.

FIG. 15B shows a three dimensional view of lens 1520. Lens 1520, for example, can be made from extruded or injection molded plastic. Various other manufacturing techniques can be used to manufacture lens 1520. Lens 1520 includes pocket 1515 that extends along the length of lens 1520 and allows for a plurality of LEDs that are arranged along the length of the lens to be positioned within pocket 1515. A holder or bracket can be coupled with the ends of lens 1520 that can keep lens positioned away from circuit board 608. Moreover, the holder or bracket can be coupled with a heat sink. The holder or bracket can be screwed into the heat sink and also contain features to apply pressure to the LED board for maximum thermal contact between the LED board and the heat sink.

Figure 16:
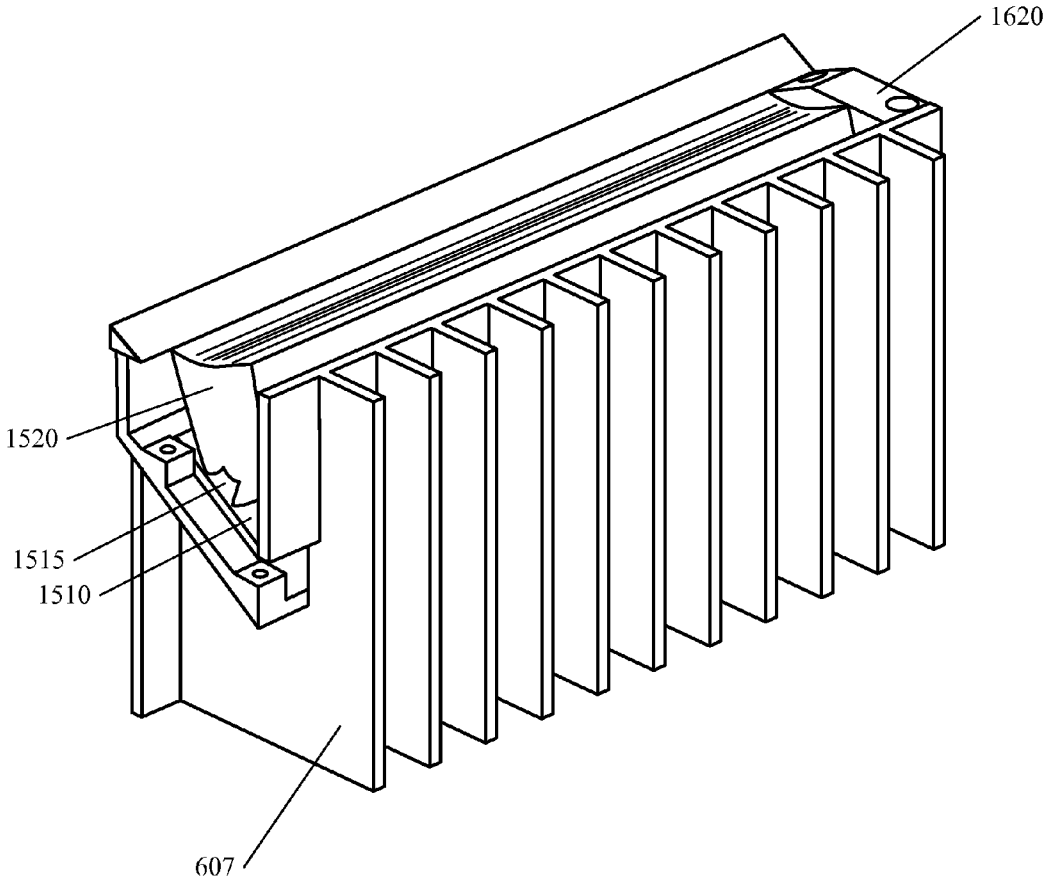
FIG. 16 shows a lens and a circuit board positioned within a heat sink according to some embodiments of the invention.

FIG. 16 shows lens 1520 and circuit board 608 positioned within heat sink 607. Heat sink 607 can conduct heat away from circuit board 608 and/or lens 1520. Heat sink 607 also acts as a holder for lens 1520 and circuit board 608. In this way, proper conductive contact is assured. Various other heat sink configurations can be used. Holders 1620 can be used to secure lens 1520 and circuit board 608 together and within heat sink 607.

FIG. 17 shows an exploded view of portions of primary optical subsystem. Circuit board 608 includes LEDs arranged along the length of the board. Lens 1520 is positioned above circuit board 608. Holders 1620 coupled with the ends of circuit board 608 and lens 1520 can be used to keep some distance between circuit board 608 and lens 1520 and align LEDs to circuit board 608. Moreover, holders can be used to couple both circuit board 608 and lens 1520 with heat sink 607. Screws or bolts can be used to fasten holders 1620 with heat sink 607. As shown in the figure, holders 1620 have cutouts with the same cross-sectional shape as lens 1520.

Luminaires described herein can include any number of sizes, dimensions and/or configurations. For example, a luminaire housing can be less than 3.625 inches deep, in the in-wall direction. Luminaires can also have a width that is less than the standard commercial and/or residential stud width of 24 or 16 inches. That is, the width of the luminaire housing can be at or less than 22⅜ or 14⅜ inches.

In some embodiments, the primary optical subsystem and/or the secondary optical subsystem (or components thereof) can be located anywhere within the aperture. For example, primary optical subsystem and/or the secondary optical subsystem can be disposed on the sides, below, and/or above the aperture as well as within the aperture. Moreover, the secondary optical subsystem can include a plurality of secondary optical subsystems disposed in various locations and/or independently controllable in both spectrum and total output. For example, a first secondary optical subsystem can be disposed at the top of the aperture that provides blue light, and a second secondary optical subsystem can be disposed at the bottom that provides red light. This example can provide a vertical gradient from red to blue.

While many luminaries have been described in a wall-recessed configuration, embodiments of the invention are not limited thereby. Luminaires described herein may be recessed in any surface such as a ceiling, counter, ground, or floor. For example, in a ceiling configuration, the secondary optical subsystem may provide a light distribution representative of a skylight. In some configurations, the primary optical subsystem can provide indirect light on a wall. And in some configurations, a plurality of primary optical subsystems can exist and may provide indirect light on one or more walls.

In some embodiments, the primary optical subsystem can be used to provide a floor wash. For example, the luminaire system can be positioned near a floor with the secondary optical subsystem providing various illumination conditions and the primary optical subsystem illuminating the floor. Such a luminaire can be used for step or night lighting solutions.

Figure 18:
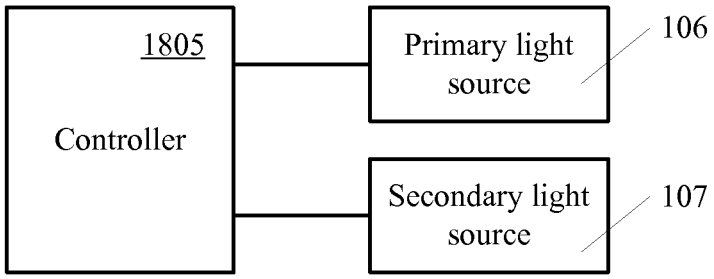
FIG. 18 shows a block diagram of a controller coupled with a primary optical subsystem and a secondary optical subsystem.

FIG. 18 shows a block diagram of controller 1805 coupled with primary optical subsystem 1810 and secondary optical subsystem 1815. Controller 1805 can control power to the light sources. In some embodiments, controller 1805 may control distinct light sources within primary optical subsystem 1810 and/or secondary optical subsystem 1815.

Controller 1805 can change the characteristic of the light emitted from primary optical subsystem 1810 and/or secondary optical subsystem 1815. For example, controller 1805 can be coupled with distinct light sources and/or dynamic filters to adjust the quantity of light and/or color of either or both primary optical subsystem 1810 and secondary optical subsystem 1815 throughout the day to correlate the quantity of light and/or color of light based on the time of day and/or day of the year. As one example, the produced light may be greater during midday and lesser at night. As another example, the produced light may include more red and yellow hues during sunrise and sunset. Controller 1805 may also be coupled with various actuators.

Controller 1805 may also adjust the brightness and/or color of the light based on real-time weather phenomena. For example, the controller can include a network card (e.g., WiFi or cellular network card etc.) that communicates with a database that updates local weather conditions in real-time. Based on information in the database, the controller can change the quantity of light, brightness, gradient and/or spectrum of the light produced by either or both the primary optical subsystem 1810 and secondary optical subsystem 1815 based on real-time weather events. As another example, the controller can include a database of weather events and can randomly adjust the characteristic of light by randomly selecting a weather event from the database. In some embodiments, the controller can dynamically control the quantity of light, brightness, luminous or chromatic gradient and/or color of the light emitted from the primary and/or secondary light sources in any way; for example, in a way that is visually interesting or pleasing and/or that adds to the ambiance of the architectural space.

In some embodiments, controller 1805 can provide independent control of primary optical subsystem 106 and secondary optical subsystem 107. This independent control can control the luminance, color, distribution, look, and/or feel of the light independently for the two optical subsystems. In some embodiments, controller 1805 can provide appearance compensation. For instance, when the emitted light of one optical subsystem changes from in appearance, the other subsystem can also change in order to compensate for the new look and feel of the overall system.

In some embodiments, a plurality of luminaires and/or luminaire subsystems can be controlled in a coordinated fashion. That is, the temporal and/or spatial effects can be created among the plurality of luminaires and/or luminaire subsystems. For example, in a first state, each of the plurality of luminaires and/or luminaire subsystems can provide a static luminous presentation. In a second state, a "ripple" of color could be sent across the plurality of luminaires and/or luminaire subsystems. As another example, a user could specify a different color scheme for the secondary component of each of four corners of a two dimensional array of luminaires and/or luminaire subsystems. A combination of software and/or control system can be used to automatically blend/transition the color of all the other luminaires based on each one's relative spatial proximity of the plurality of luminaires and/or luminaire subsystems.

In some embodiments, controller 1805 can include a plurality of controllers and/or drivers. Moreover, in some embodiments, controller 1805 can include multiple controllers distributed among a plurality of luminaries. Moreover, controller 1805 can include one or more light drivers.

Figure 19:
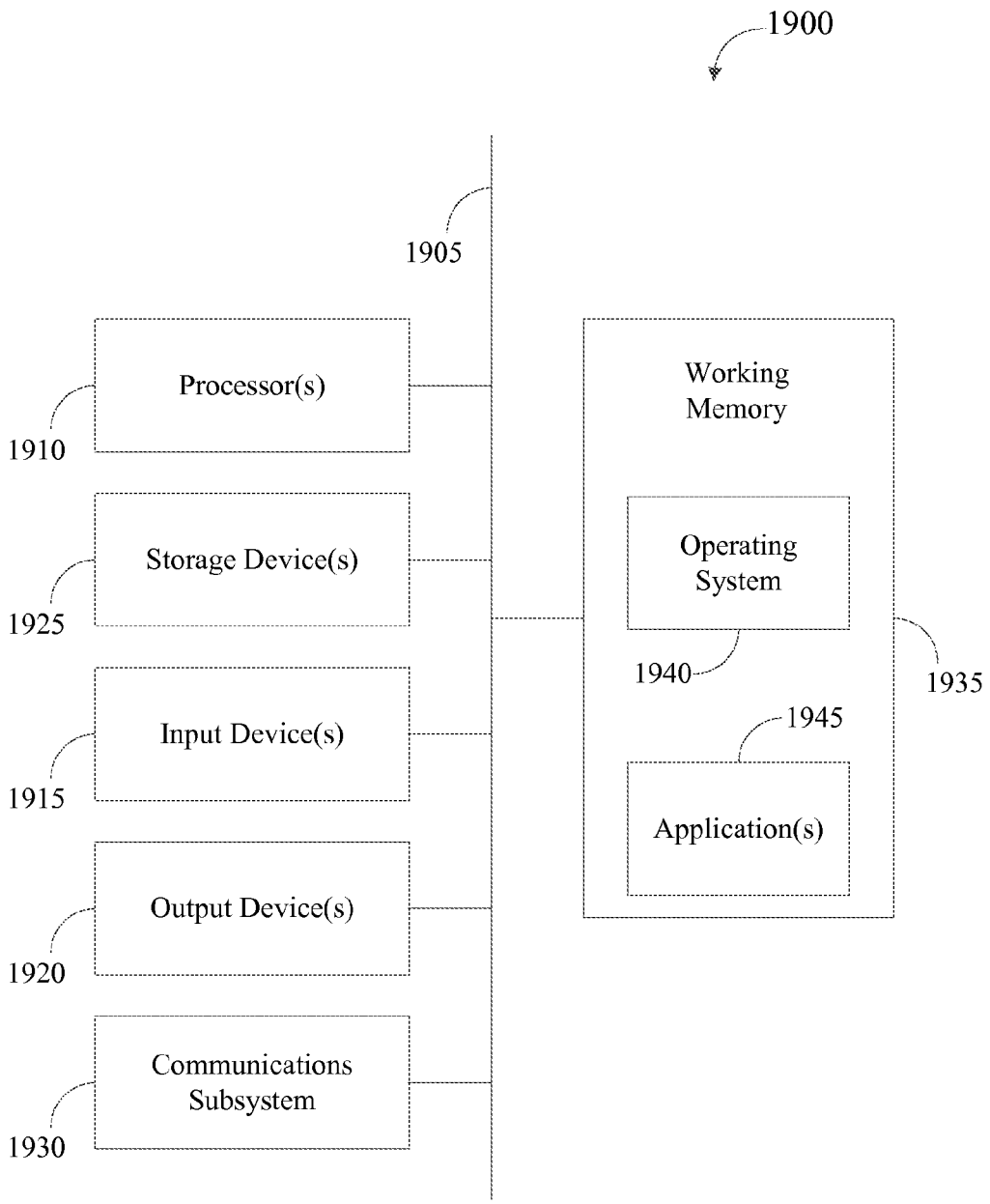
FIG. 19 shows an illustrative computational system for performing functionality to facilitate implementation of embodiments described herein.

The computational system 1900, shown in FIG. 19, can be used to perform control functions described herein. Controller 1805 can include all or portions of computational system 1900. As another example, computational system 1900 can be used to perform any program or simulation described herein. Furthermore, computational system 1900 can be used to control various LEDs and/or light sources.

Computational system 1900 includes hardware elements that can be electrically coupled via a bus 1905 (or may otherwise be in communication, as appropriate). The hardware elements can include one or more processors 1910, including without limitation one or more general-purpose processors and/or one or more special-purpose processors (such as digital signal processing chips, graphics acceleration chips, and/or the like); one or more input devices 1915, which can include without limitation a mouse, a keyboard and/or the like; and one or more output devices 1920, which can include without limitation a display device, a printer and/or the like.

The computational system 1900 may further include (and/or be in communication with) one or more storage devices 1925, which can include, without limitation, local and/or network accessible storage and/or can include, without limitation, a disk drive, a drive array, an optical storage device, a solid-state storage device, such as a random access memory ("RAM") and/or a read-only memory ("ROM"), which can be programmable, flash-updateable and/or the like. The computational system 1900 might also include a communications subsystem 1930, which can include without limitation a modem, a network card (wireless or wired), an infrared communication device, a wireless communication device and/or chipset (such as a Bluetooth device, an 802.6 device, a WiFi device, a WiMax device, cellular communication facilities, etc.), and/or the like. The communications subsystem 1930 may permit data to be exchanged with a network (such as the network described below, to name one example), and/or any other devices described herein. In many embodiments, the computational system 1900 will further include a working memory 1935, which can include a RAM or ROM device, as described above.

The computational system 1900 also can include software elements, shown as being currently located within the working memory 1935, including an operating system 1940 and/or other code, such as one or more application programs 1945, which may include computer programs of the invention, and/or may be designed to implement methods of the invention and/or configure systems of the invention, as described herein. For example, one or more procedures described with respect to the method(s) discussed above might be implemented as code and/or instructions executable by a computer (and/or a processor within a computer). A set of these instructions and/or codes might be stored on a computer-readable storage medium, such as the storage device(s) 1925 described above.

In some cases, the storage medium might be incorporated within the computational system 1900 or in communication with the computational system 1900. In other embodiments, the storage medium might be separate from a computational system 1900 (e.g., a removable medium, such as a compact disc, etc.), and/or provided in an installation package, such that the storage medium can be used to program a general purpose computer with the instructions/code stored thereon. These instructions might take the form of executable code, which is executable by the computational system 1900 and/or might take the form of source and/or installable code, which, upon compilation and/or installation on the computational system 1900 (e.g., using any of a variety of generally available compilers, installation programs, compression and/or decompression utilities, etc.) then takes the form of executable code.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A luminaire for illuminating an architectural space, the luminaire comprising:

a housing comprising a plurality of housing walls, wherein a first housing wall comprises a front face facing the architectural space and an aperture extending through the first housing wall and defined by aperture edges;

a primary optical subsystem disposed within the housing such that it is not positioned between the aperture edges when viewed through the aperture perpendicularly to the front face, the primary optical subsystem producing a primary photometric distribution;

at least one secondary optical subsystem disposed within the housing, the at least one secondary optical subsystem producing a secondary photometric distribution different from the primary photometric distribution; and a diffuser positioned between the aperture edges when viewed through the aperture perpendicularly to the front face and such that at least a portion of the diffuser is visible within the housing when viewed through the aperture perpendicularly to the front face, wherein the diffuser extends from the first housing wall and comprises a portion that curves away from the first housing wall toward an interior of the housing, wherein the diffuser is positioned within the housing to extend toward a second housing wall such that a majority of at least one of the primary optical subsystem and the at least one secondary optical subsystem is disposed between (i) a projected intersection between the diffuser and the second housing wall and (ii) the first housing wall, wherein a majority of light in the primary photometric distribution does not pass through the diffuser and a majority of light in the secondary photometric distribution does pass through the diffuser.

2. The luminaire of claim 1, wherein:

the primary optical subsystem is disposed within the housing proximate the second housing wall;

the primary photometric distribution has a centerline directed through the aperture at an angle to the first housing wall; and a majority of light in the primary photometric distribution is directed through the aperture at an angle to the first housing wall such that the luminaire is configured to illuminate a surface in the architectural space that is nonparallel with the front face of the housing.

3. The luminaire of claim 1, wherein the secondary photometric distribution is distributed across the entire aperture.

4. The luminaire of claim 1, wherein:

the diffuser and the aperture each have an area; and the area of the diffuser is greater than the area of the aperture.

5. The luminaire of claim 1, wherein the diffuser comprises a convex portion facing the interior of the housing.

6. The luminaire of claim 1, wherein the diffuser comprises a first diffuser edge and an opposing second diffuser edge, wherein the diffuser extends from the first housing wall toward the second housing wall that is non-parallel to the first housing wall, and wherein the first diffuser edge and the second diffuser edge are disposed within the housing on opposing sides of the aperture.

7. The luminaire of claim 1, wherein a majority of the primary optical subsystem is disposed between (i) the projected intersection between the diffuser and the second housing wall and (ii) the first housing wall.

8. The luminaire of claim 7, wherein the at least one secondary optical subsystem is located within the housing adjacent to the second housing wall such that a majority of the at least one secondary optical subsystem is disposed on a side of the projected intersection between the diffuser and the second housing wall opposite the primary optical subsystem.

9. The luminaire of claim 1, wherein the primary and at least one secondary optical subsystems are independently controlled.

10. The luminaire of claim 1, wherein the primary optical subsystem emits substantially white light.

11. The luminaire of claim 1, wherein the at least one secondary optical subsystem emits colored light.

12. The luminaire of claim 11, wherein the at least one secondary optical subsystem comprises red, green, and blue light sources and a net color of the emitted colored light is adjustable.

13. The luminaire of claim 1, wherein the at least one secondary optical subsystem comprises a first secondary optical subsystem and a second secondary optical subsystem.

14. The luminaire of claim 13, wherein the first secondary optical subsystem is disposed adjacent to the second housing wall and the second secondary optical subsystem is disposed adjacent to a third housing wall opposite the second housing wall.

15. The luminaire of claim 13, wherein the first and second secondary optical subsystems are independently controllable to vary at least one of a quantity or a color of light emitted from each of the first and second secondary optical subsystems.

16. The luminaire of claim 13, wherein the first and second secondary optical subsystems create a light gradient seen through the aperture.

17. The luminaire of claim 16, wherein the light gradient seen through the aperture is configured with light of a first color in a first portion of the luminaire seen through the aperture and with light of a second color in a second portion of the luminaire seen through the aperture.

18. The luminaire of claim 16, wherein the light gradient is configured to vary at least one of brightness, hue, and saturation.

19. The luminaire of claim 1, further comprising side surfaces that extend rearwardly into the housing from the aperture edges.

20. The luminaire of claim 19, wherein the side surfaces are substantially perpendicular to the first housing wall.

21. The luminaire of claim 1, further comprising side surfaces that extend rearwardly into the housing from the aperture edges, wherein the diffuser is disposed within the housing adjacent to a rear portion of the side surfaces.

22. The luminaire of claim 1, wherein:

the luminaire is mounted in a vertical wall;

the aperture edges comprise a top aperture edge, a bottom aperture edge opposite of the top aperture edge, and two opposing side aperture edges;

the front face is approximately flush with the vertical wall; and the primary optical subsystem is disposed within the housing below the bottom aperture edge.

23. The luminaire of claim 1, wherein:

the primary optical subsystem is disposed adjacent to an intersection of the first housing wall with the second housing wall; and an internal surface of the first housing wall and an internal surface of the second housing wall form an approximately 90° angle with one another.

24. The luminaire of claim 1, wherein a first area illuminated by the primary photometric distribution overlaps with a second area illuminated by the secondary photometric distribution.

25. The luminaire of claim 1, wherein:

the luminaire is positioned on a vertical wall;

the aperture comprises a center;

the aperture edges comprise a top aperture edge, a bottom aperture edge opposite of the top aperture edge, and two opposing side aperture edges;

the luminaire further comprises a luminaire photometric distribution comprising the primary photometric distribution and the secondary photometric distribution; and the luminaire photometric distribution is asymmetrical about a plane that extends through the center of the aperture parallel to the top and bottom aperture edges and orthogonal to the two opposing side aperture edges.

26. The luminaire of claim 1, wherein:

the luminaire is positioned on a vertical wall;

the aperture comprises a center;

the aperture edges comprise a top aperture edge, a bottom aperture edge opposite of the top aperture edge, and two opposing side aperture edges;

the primary optical subsystem and the at least one secondary optical subsystem are positioned asymmetrically within the housing about a plane that extends through the center of the aperture parallel to the top and bottom aperture edges and orthogonal to the two opposing side aperture edges.

27. A luminaire for illuminating an architectural space, the luminaire comprising:

a housing comprising a plurality of housing walls, wherein a first housing wall comprises a front face facing the architectural space and an aperture extending through the first housing wall and defined by aperture edges;

side surfaces that extend rearwardly into the housing from at least one of the aperture edges;

a first optical subsystem and a second optical subsystem, wherein at least one of the first optical subsystem and the second optical subsystem is disposed within the housing and configured to emit light through the aperture such that at least one of the first optical subsystem and the second optical subsystem is not positioned between the aperture edges when viewed through the aperture perpendicularly to the front face and such that at least one of the first optical subsystem and the second optical subsystem is invisible within the housing when viewed through the aperture perpendicularly to the front face; and a diffuser attached to the housing and extending across a majority of the aperture when viewed perpendicularly to the front face, wherein the diffuser curves away from the first housing wall into the housing and wherein the diffuser comprises a distal edge that is disposed (i) inside the housing and (ii) rearward of at least one of the first optical subsystem and the second optical subsystem, wherein:

the first optical subsystem is disposed adjacent to a second housing wall and the second optical subsystem is disposed adjacent to a third housing wall that is opposite the second housing wall in the housing; and a majority of light from the first optical subsystem does not pass through the diffuser and a majority of light from the second optical subsystem does pass through the diffuser.

28. The luminaire of claim 27, wherein a all light from the second optical subsystem passes through the diffuser.

29. The luminaire of claim 27, wherein the first optical subsystem and the second optical subsystem are independently controllable to vary at least one of a quantity or a color of light emitted from the first optical subsystem and the second optical subsystem.

30. The luminaire of claim 27, wherein:

at least one of the first optical subsystem and the second optical subsystem produces a photometric distribution with a centerline directed through the aperture at an angle to the first housing wall; and a majority of light in the photometric distribution is directed through the aperture at an angle to the first housing wall such that the luminaire is configured to illuminate a surface that is nonparallel with the front face of the housing.

31. The luminaire of claim 27, wherein the diffuser extends from the first housing wall and comprises a convex portion facing an interior of the housing.

32. The luminaire of claim 27, wherein:

the luminaire is mounted in a vertical wall;

the front face is approximately flush with the vertical wall; and at least one of the first optical subsystem and the second optical subsystem is disposed within the housing below a lower aperture edge.

33. The luminaire of claim 27, wherein the diffuser is disposed adjacent to a rear portion of the side surfaces within the housing.

34. The luminaire of claim 27, wherein the side surfaces are substantially perpendicular to the first housing wall.

35. The luminaire of claim 27, wherein:

at least one of the first optical subsystem and the second optical subsystem is disposed adjacent to an intersection of the first housing wall with a second housing wall; and an internal surface of the first housing wall and an internal surface of the second housing wall form an approximately 90° angle with one another.

36. The luminaire of claim 27, wherein the diffuser is positioned within the housing to extend toward a second housing wall such that a majority of at least one of the first optical subsystem and the second optical subsystem is disposed between (i) a projected intersection between the diffuser and the second housing wall and (ii) the first housing wall.

37. The luminaire of claim 36, wherein a majority of the first optical subsystem is disposed between (i) the projected intersection between the diffuser and the second housing wall and (ii) the first housing wall.

38. A luminaire for illuminating an architectural space, the luminaire comprising:

a housing comprising a plurality of walls, wherein a first housing wall comprises a front face facing the architectural space and an aperture extending through the first housing wall and defined by aperture edges;

a primary optical subsystem, the primary optical subsystem producing a primary photometric distribution;

at least one secondary optical subsystem, the at least one secondary optical subsystem producing a secondary photometric distribution different from the primary photometric distribution; and a diffuser attached to the housing and extending across at least part of the aperture when viewed perpendicularly to the front face, wherein the diffuser curves away from the first housing wall into the housing and wherein the diffuser is positioned within the housing to extend toward a second housing wall such that a majority of the primary optical subsystem is disposed between (i) a projected intersection between the diffuser and the second housing wall and (ii) the first housing wall, wherein the primary optical subsystem and the at least one secondary optical subsystem are disposed within the housing such that they are not positioned between the aperture edges when viewed through the aperture perpendicularly to the front face and such that all of the optical subsystems are invisible within the housing when viewed through the aperture perpendicularly to the front face, and wherein a majority of light in the primary photometric distribution does not pass through the diffuser and a majority of light in the secondary photometric distribution does pass through the diffuser.

39. The luminaire of claim 38, wherein the at least one secondary optical subsystem is disposed on a planar surface that is perpendicular to the front face.

40. The luminaire of claim 38, wherein:

the at least one secondary optical subsystem comprises a first secondary optical subsystem and a second secondary optical subsystem;

the first secondary optical subsystem is disposed within the housing on a planar surface that is perpendicular to the front face; and the second secondary optical subsystem is disposed within the housing such that the second secondary optical subsystem is at least partially aimed toward a rear portion of the housing.

41. The luminaire of claim 38, wherein:

the at least one secondary optical subsystem comprises a first secondary optical subsystem and a second secondary optical subsystem;

the first secondary optical subsystem is disposed within the housing on a first side of the aperture; and the second secondary optical subsystem is disposed within the housing on a second side of the aperture opposite the first side of the aperture.

42. The luminaire of claim 38, wherein:

the at least one secondary optical subsystem is disposed within the housing either (i) on a planar surface that is perpendicular to the front face or (ii) on a surface such that the at least one secondary optical subsystem is at least partially aimed toward a rear portion of the housing.

* * * * *